US009140037B2

(12) United States Patent
Nagaoka et al.

(10) Patent No.: US 9,140,037 B2
(45) Date of Patent: Sep. 22, 2015

(54) VEHICLE DOOR LOCK DEVICE

(75) Inventors: Tomoharu Nagaoka, Yokohama (JP); Yuya Murakami, Yokohama (JP)

(73) Assignee: MITSUI KINZOKU ACT CORPORATION (JP)

( * ) Notice: Subject to any disclaimer, the term of this patent is extended or adjusted under 35 U.S.C. 154(b) by 186 days.

(21) Appl. No.: 13/517,133

(22) PCT Filed: Sep. 30, 2010

(86) PCT No.: PCT/JP2010/067043

§ 371 (c)(1),
(2), (4) Date: Jun. 19, 2012

(87) PCT Pub. No.: WO2011/077799

PCT Pub. Date: Jun. 30, 2011

(65) Prior Publication Data

US 2012/0256429 A1 Oct. 11, 2012

(30) Foreign Application Priority Data

Dec. 21, 2009 (JP) ..... 2009-288867

(51) Int. Cl.

| | |
|---|---|
| ***E05C 19/00*** | (2006.01) |
| ***E05B 77/34*** | (2014.01) |
| ***E05B 81/06*** | (2014.01) |
| ***E05B 85/02*** | (2014.01) |
| ***E05B 81/16*** | (2014.01) |
| ***E05B 81/34*** | (2014.01) |

(52) U.S. Cl.

CPC ..... *E05B 77/34* (2013.01); *E05B 81/06* (2013.01); *E05B 81/16* (2013.01); *E05B 81/34* (2013.01); *E05B 85/02* (2013.01); *Y10T 292/108* (2015.04)

(58) Field of Classification Search

CPC ..... E05B 81/06; E05B 81/14
USPC ..... 292/200, 201, 216, DIG. 23, 279, 280
See application file for complete search history.

(56) References Cited

U.S. PATENT DOCUMENTS

| | | | | |
|---|---|---|---|---|
| 5,348,357 | A * | 9/1994 | Konchan et al. | 292/216 |
| 5,649,726 | A * | 7/1997 | Rogers et al. | 292/201 |
| 5,802,894 | A * | 9/1998 | Jahrsetz et al. | 70/264 |

(Continued)

FOREIGN PATENT DOCUMENTS

| | | |
|---|---|---|
| JP | 2002-129802 | 5/2002 |
| JP | 2002-138730 | 5/2002 |
| JP | 3736267 | 1/2006 |

OTHER PUBLICATIONS

International Search Report mailed Dec. 28, 2010 in corresponding PCT International Application No. PCT/JP2010/067043.

*Primary Examiner* — Kristina Fulton
*Assistant Examiner* — Nathan Cumar
(74) *Attorney, Agent, or Firm* — Ostroelnk Faber LLP

(57) ABSTRACT

A vehicle door latch device configured so that the pivoting of a gear which is performed by motor drive reliably moves a lock lever to a lock position and an unlock position. When a lock lever is at a lock position, if a worm wheel is rotated in one direction by a motor, a first engagement protrusion section makes contact with a first engagement arm in the direction of the pivoting thereof, the lock lever is pivoted to an unlock position, and after that, a second engagement protrusion section makes contact with a pivoting end section of a second engagement arm to cause the worm wheel to stop at a first stop position. Also, when the lock lever is at the unlock position, if the worm wheel is rotated in the other direction by the motor, a second engagement protrusion section makes contact with the second engagement arm in the direction of the pivoting thereof, the lock lever is pivoted to a lock position, and after that, a first engagement protrusion section makes contact with a pivoting end section of the first engagement arm to cause the worm wheel to stop at a second stop position.

6 Claims, 20 Drawing Sheets

(56) References Cited

U.S. PATENT DOCUMENTS 6,102,453 A * 8/2000 Cetnar ..... 292/201
6,109,674 A * 8/2000 Bartel et al. ..... 292/337
6,494,505 B2 * 12/2002 Kobayashi et al. ..... 292/201
6,945,574 B2 * 9/2005 Hayakawa et al. ..... 292/201

* cited by examiner

VEHICLE DOOR LOCK DEVICE

CROSS-REFERENCE TO RELATED APPLICATIONS

The present application is a 35 U.S.C. §§371 national phase conversion of PCT/JP2010/067043, filed Sep. 30, 2010, which claims priority of Japanese Patent Application No. 2009-288867, filed Dec. 21, 2009, the contents of which are incorporated herein by reference. The PCT International Application was published in the Japanese language.

TECHNICAL FIELD

The present invention relates to a vehicle door lock device in a locked state and an unlocked state.

BACKGROUND OF THE INVENTION

An actuator in a vehicle door latch device comprises a motor, a worm wheel turned by the motor, and a locking lever (active lever) movable between a locking position and an unlocking position by manually operating means such as a key cylinder and a locking knob on a door and by a motor. One rotary surface of the worm wheel is rotatably supported on a casing and the other rotary surface of the worm wheel is selectively engagable with the locking lever to allow the locking lever to turn to the locking and unlocking positions with rotation of the worm wheel as described in Patent Literature 1.

PRIOR ART

Patent Literature

Patent Literature 1: JP3736267B2

SUMMARY OF THE INVENTION

Problems to be Solved by the Invention

However, in the actuator in the vehicle door latch device as above, when the locking lever moves to the locking or unlocking position with the worm wheel driven by the motor, further rotation of the locking lever is forcedly checked and a force toward a rotation axis exerts onto the worm wheel, so that the worm wheel may float toward the rotation axis. Thus, excessive load acts to a bearing of the worm wheel which is inclined toward the rotation axis thereby making the engagement of the worm wheel and a worm of the motor less reliable, so that the locking lever is unlikely to move to locking and unlocking positions.

In view of the disadvantage, it is an object of the invention to provide a vehicle door lock device in which a locking lever can be moved securely to locking and unlocking positions when a gear between two engagement arms of the locking lever is driven and rotated by a motor.

EMBODIMENTS FOR CARRYING OUT THE INVENTION

One embodiment of the present invention will be described with respect to the drawings as below. In the following description, the back in FIG. 2 and left in FIG. 3 are the front of a vehicle; the front in FIG. 2 and right in FIG. 3 are the rear of the vehicle; the right in FIG. 2 and back in FIG. 3 are toward the outside of the vehicle; and the left in FIG. 2 and front in FIG. 3 are toward the inside of the vehicle.

Figure 1:
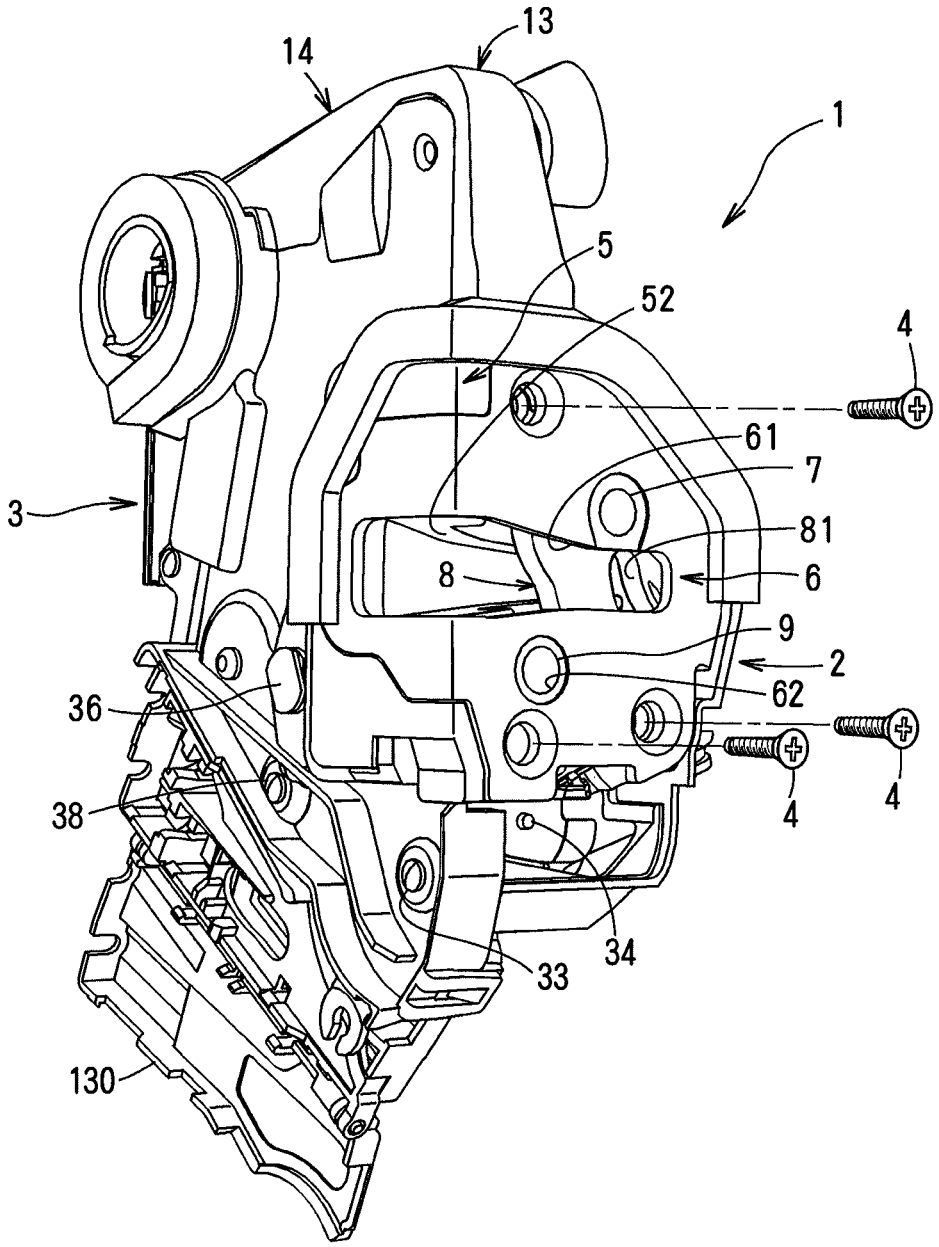
[FIG. 1] A perspective view of a door latch device according to the present invention.
Figure 2:
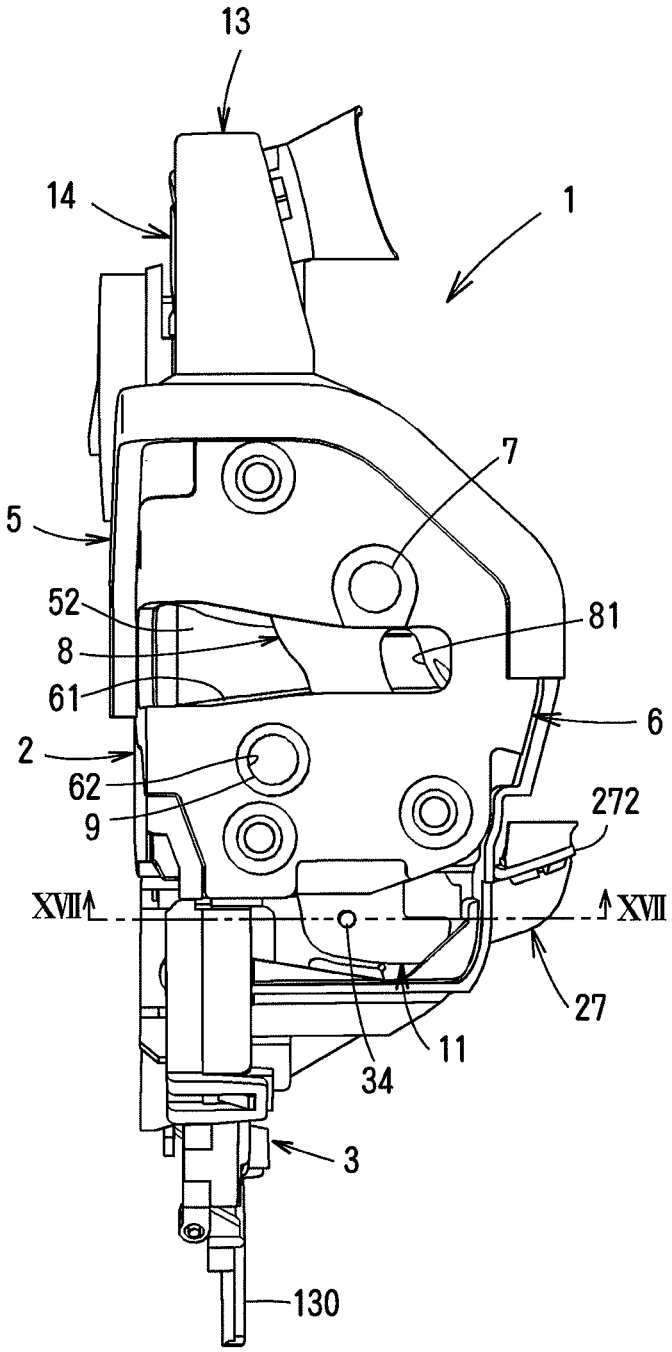
[FIG. 2] A front elevational view of the door latch device.
Figure 3:
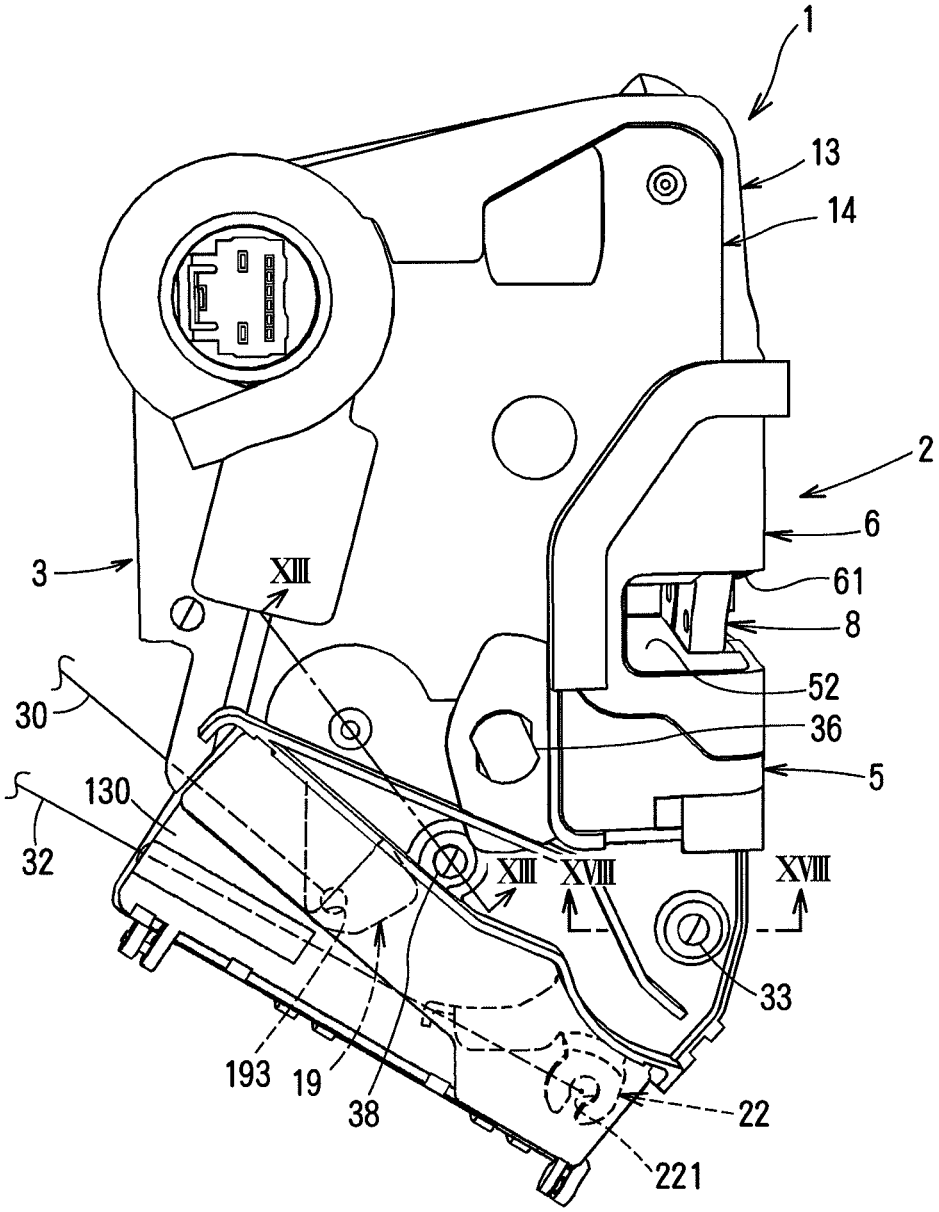
[FIG. 3] A side view of the door latch device seen from the interior of a vehicle.

In FIGS. 1-3, a door latch device 1 is mounted to the inner side at the rear end of a front door in a motor vehicle, and comprises an engagement unit 2 for holding the door in a closed state and an operational unit 3 connected to the engagement unit 2.

Figure 4:
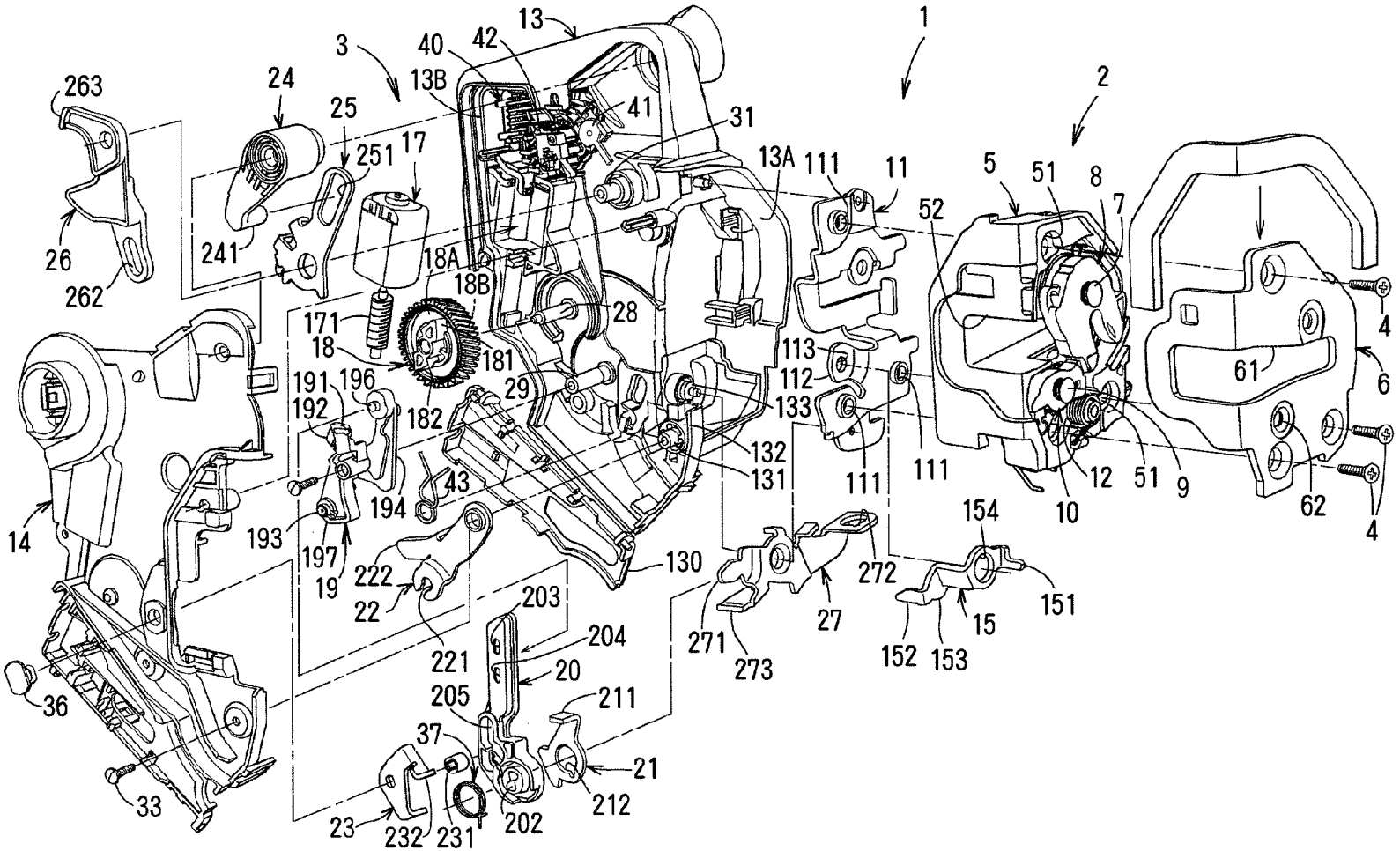
[FIG. 4] An exploded perspective view of the door latch device.
Figure 5:
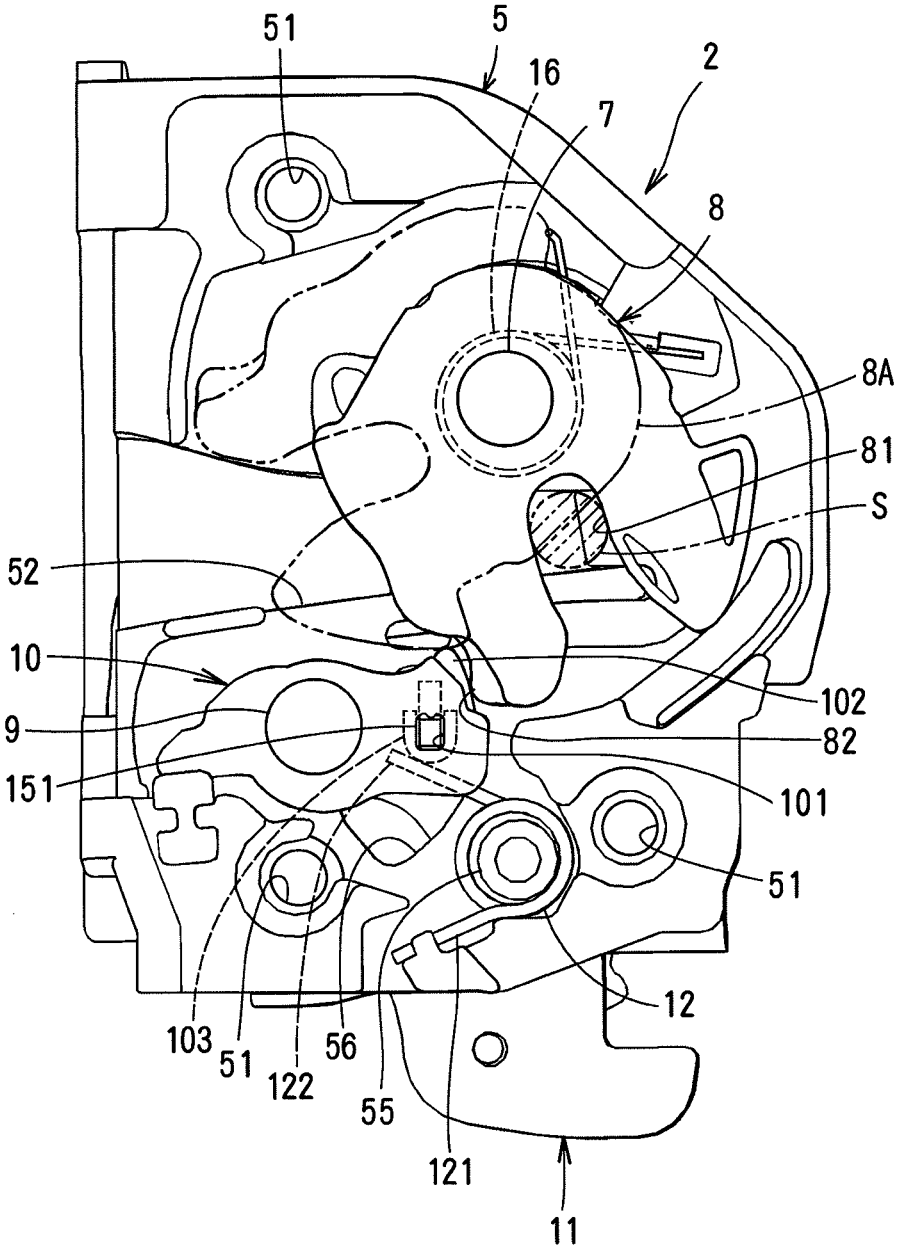
[FIG. 5] A front elevational view showing the internal structure of an engagement unit in the door latch device.
Figure 6:
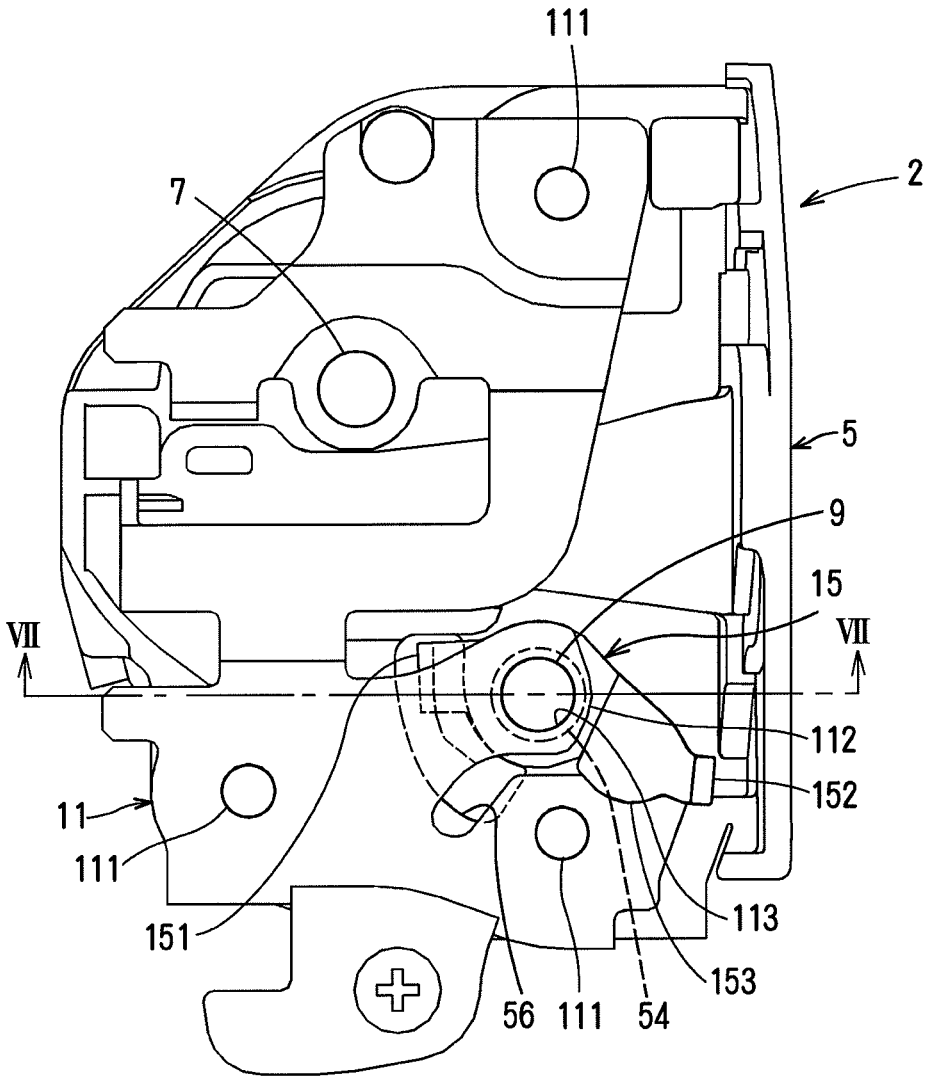
[FIG. 6] A rear elevational view of the engagement unit of the door latch device.

In FIGS. 4-6, the engagement unit 2 comprises a synthetic resin body 5 fixed to an inner panel at the rear end of the door with three bolts; a metal cover plate 6 for closing an opening at the rear surface of the body; a latch 8 pivoting between the body 5 and the cover plate 6 in the body 5 to engage with a striker S fixed to the vehicle body when the door is closed; a ratchet 10 pivotally mounted between the body 5 and the cover plate 5 in the body 5 to engage with the latch 8; and an opening lever 15 disposed between the body 5 and the back plate 11 to rotate together with the ratchet 10. For clarity of the internal structure of the body 5, the cover plate 6 is removed.

Figure 7:
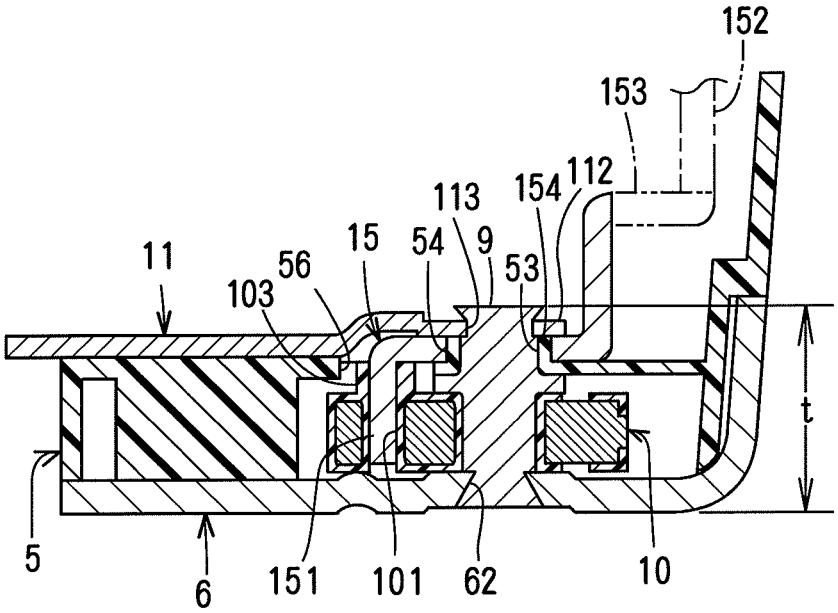
[FIG. 7] A horizontal sectional view taken along the line VII-VII in FIG. 6.

In the body 5, there is formed a bolt-inserting hole 51 through which the bolt 4 is put; a striker-engagement groove 52 in which the striker S engages when the door is closed, in the rear face; and a cylindrical support 54 projecting to a back plate 11 around an axial hole 53 into which a ratchet shaft 9 is inserted to support a ratchet 10 pivotally, in the front face in FIG. 7.

The latch 8 is pivotally mounted via a latch shaft 7 in the body 5 and is forced by a spring 16 around the latch shaft 5 toward a standby position 8A drawn by two dotted lines in FIG. 5.

The ratchet 10 is pivotally mounted via a ratchet shaft 9 in the body 5 and is forced by a spring 12 supported by a projection 55 integrally formed with the body 5 below the ratchet shaft 9 toward an engagement position in FIG. 5. On the side of the ratchet 10, there is formed an engagement hole 101 in which a bent engagement 151 of the opening lever 15 engages.

In FIG. 7, the ratchet shaft 9 is disposed in an axial hole 62 of the cover plate 62, an axial hole 53 of the body 5 and an axial hole 113 of the back plate 11. One end of the ratchet shaft 9 at the cover plate 6 and the other end at the back plate 11 are caulked around an axial hole 61 in the cover plate 6 and around an axial hole 113 in the back plate 11 respectively.

In FIG. 5, one end 121 of the spring engages the body 5, and the other end 122 engages a U-shaped projection 103 around an engagement hole 101 in a front face of the ratchet 10 thereby applying a force to the ratchet 10 in a direction of engagement with the latch 8 and transmitting the force to the opening lever 15 via the ratchet 10.

In a full-latch position where the latch 8 engages the striker S as shown by a solid line in FIG. 5 when the door is closed, an engaging portion 102 at the end of the ratchet 10 engages a pawl 82 of the latch 8 to hold the latch 8 in the full-latch position. In a standby position 8A where the latch 8 disengages from the striker S when the door is open, the engaging portion 102 of the ratchet 10 abuts the outer periphery without engagement with the pawl 82 of the latch 8 A stop position of the ratchet 10 when the latch 8 is in the standby position is approximately the same as that of the ratchet 10 when the latch 8 is in the full-latch position.

When the door is closed, the striker S comes in striker-entering grooves 52,61 of the body 5 and the cover plate 6 to engage an engaging groove 81 of the latch 8. The latch 8 turns from the standby position 8A to the full-latch position against the force of the spring 16 around a pivot shaft 7. The ratchet 10 engages the pawl 82 of the latch 8 by a force of the spring 12 and prevents the latch 9 from turning toward the standby position, thereby holding the door closed.

When the door is closed, an outside handle (not shown) or an inside handle (not shown) disposed on the outer or inner side of the door respectively is operated, the ratchet 10 turns in a releasing direction (clockwise from FIG. 5) against the force of the spring 12 by turning the opening lever 15 via first and second lift levers 20,21 (described later) as releasing means, thereby enabling the engaging portion 102 of the ratchet 10 to leave the pawl 82 of the latch 8.

In FIGS. 6 and 7, the back plate 11 is fixed to the front face of the body 5 and comprises female screw holes 111 threadly engaged with bolts 4 in the body 5; a holding portion 112 abutting on the end of a holding portion 54 of the body 5; and an axial hole 113 in the holding portion 112 in which the ratchet shaft 9 is disposed.

The opening lever 15 is held between the front face of the body 5 and the holding portion 112 of the back plate 11 and has an axial hole 154 which fits the holding portion 54 of the body 5 so that the opening lever 15 can pivot together with the ratchet 10 around the same axis. The opening lever 15 comprises a bent portion 151 at one end; a released portion 153 at the other end, and a canceled portion 152 bent from the releasing portion 153.

One end of the opening lever 15 is held between the front face of the body 5 and the holding portion 112 of the back plate 11. The bent portion 151 engages an engagement hole 101 of the ratchet 10 through an arcuate hole 56 of the body 5. Thus, the opening lever 15 is coupled to the ratchet 10 to pivot together anytime.

A releasing portion 211 of a second lift lever 21 of the operational unit 3 can abut on a released portion 153 of the opening lever 15 in an unlocked state. A canceling lever 23 of the operational unit 5 can abut on the canceled portion 152 in a locked state.

The canceled portion 152 and the released portion 153 at the other end of the opening lever 15 project forward from the holding portion 112 of the back plate 11. That is to say, the cancelled portion 152 and the released portion 153 of the opening lever 5 in abutment with the parts of the operational unit 3 are not held between the body 5 and the holding portion 112 of the back plate 11, but extends forward from the holding portion 112.

As mentioned above, the following advantages are achieved by pivoting the opening lever 15 around the cylindrical support portion 54 of the body 5 and holding one side with the axial hole 154 of the opening lever 15 between the front face of the body 5 and the holding portion 112 of the back plate 11.

1) Loosening of the opening lever 15 in a direction of the rotation axis (axis of the ratchet shaft 9) can be securely prevented even if neither a washier nor a spacer is mounted to the ratchet shaft 9.

2) Neither a washier nor a spacer is mounted to the ratchet shaft 9. So, the number of parts can be reduced, saving its cost.

3) One end and the other end of the ratchet shaft 9 are caulked and fixed to the axial hole 62 of the cover plate 6 and the axial hole 113 of the back plate 11 respectively, so that the ratchet shaft 9 can be firmly fixed to the cover plate 6 and the back plate 11 thereby improving support strength of the ratchet 10 and the opening lever 15.

Then, the operational unit 3 will be described in detail. In FIG. 4, the operational unit 3 comprises a synthetic-resin casing 13 mounted in front of the body 5; and a synthetic-resin cover 14 closing over an opening of the casing 13. The casing 13 comprises a reversible motor 17 for locking and unlocking; a worm wheel 18; a locking lever 19; first and second lift levers 20,21; an inside lever 22; a canceling lever 23; a first key lever 24; a second key lever 25; an coordinating lever 26; an outside lever 27; and a switch terminal 40. The motor 17, worm wheel 18 and locking lever 19 constitute an actuator that can electrically actuate locking and unlocking of the door latch device 1.

The casing 13 comprises a first casing part 13*a* covering the front face of the body 4; and a second casing part 13B. The first casing part 13A is fixed to the body 5, and the second casing part 13B has an opening covered by the cover 14.

To the lower part of the second casing part 13b of the casing 13 is connected a lid member 130 which hides a coupling portion 193 of the locking lever 19, a coupling portion of the inside lever 22 and motion-transmitting members 30,32 coupled to the coupling portions 193, 221. The lid member 130 can open and close. The lid member 130 is open in FIG. 1 when the parts are coupled to the casing 13, and is closed in FIG. 3 after the motion-transmitting members 30,32 are coupled to the coupling portions 193, 221 of the locking lever 19 and the inside lever 22 respectively.

The first key lever 24 is pivoted around a shaft at the top of the second casing part 13B. The first key cylinder 24 is pivoted by a locking motion of a key cylinder (not shown) as manually operating means on the door outside the vehicle by predetermined angles in a locking direction (counterclockwise in FIGS. 8 and 9) from a neutral position in FIGS. 8 and 9.

The second key lever 25 is pivoted around a shaft 31 integrally formed with the second casing part 13B between the second casing part 13B and the cover 14 and has an elongate hole 251 in which a projection at the lower end of the first key lever 24 fits. With the motion of the first key lever 24, the second key lever 25 pivots by predetermined angles from the neutral position in FIGS. 8 and 9 in a locking direction (clockwise in FIGS. 8 and 9) and in an unlocking direction (counterclockwise in FIGS. 8 and 9).

A key switch 41 is provided close to the second key lever 25 in the second casing part 13B. By engaging a detecting arm 411 of the key switch 41 with the second key lever 25, the key switch 41 detects that the first and second key levers 24,25 turned from the neutral position in the unlocking and locking directions or that the key cylinder is operated for unlocking and locking.

Figure 8:
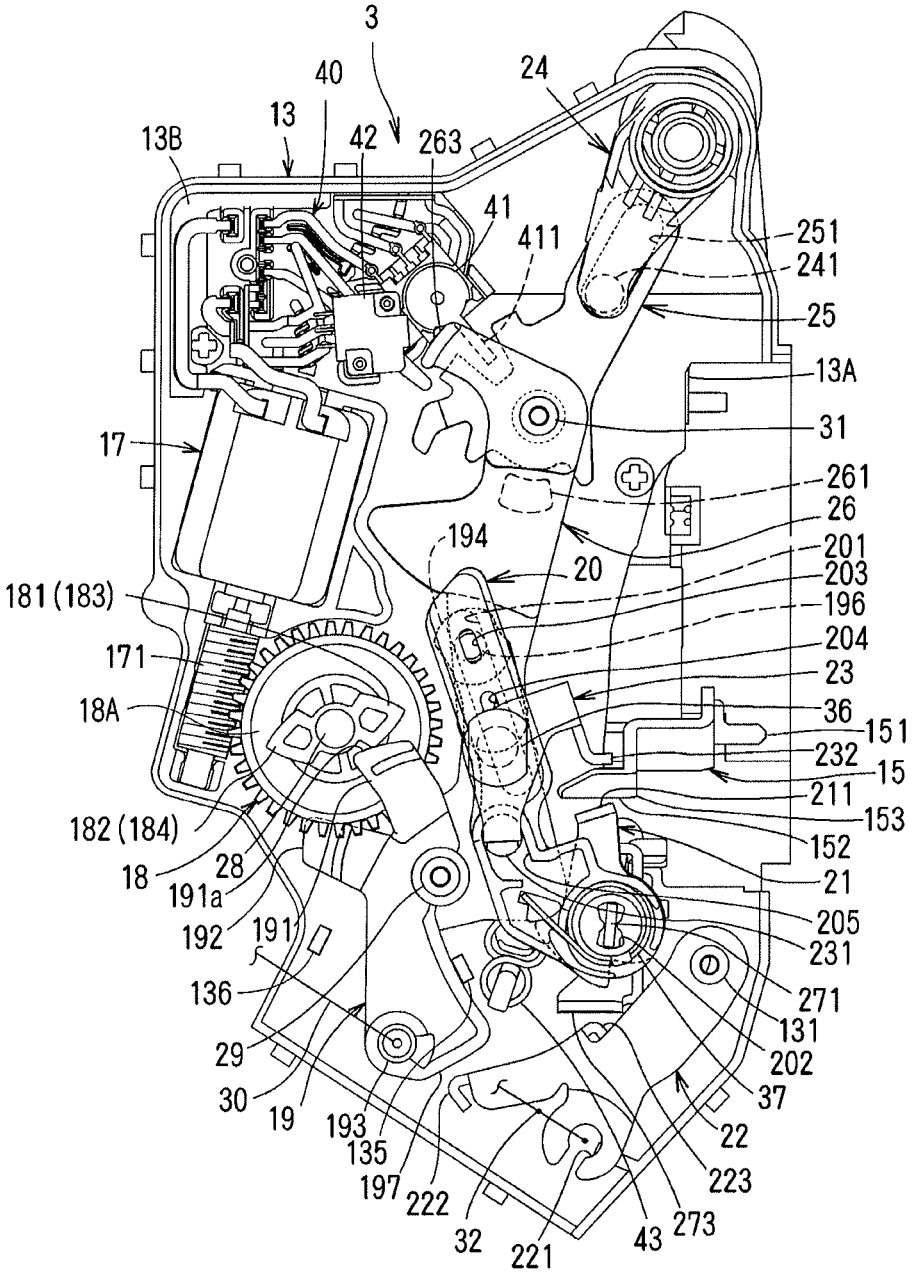
[FIG. 8] Aside elevational view of an operational unit in a locked state, seen from the interior of the vehicle.
Figure 9:
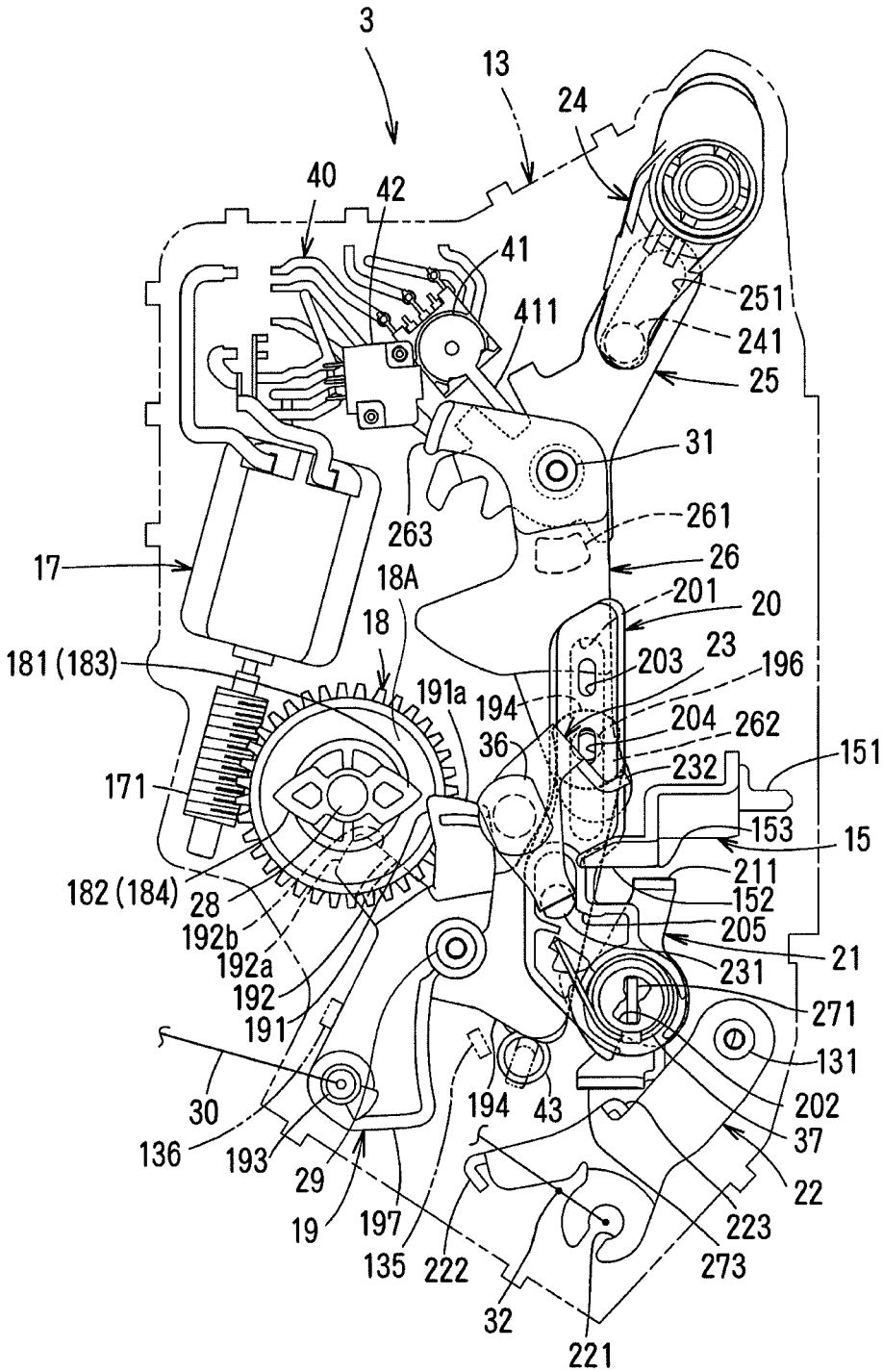
[FIG. 9] A side elevational view of the operational unit in an unlocked state, seen from the interior of the vehicle.
Figure 10:
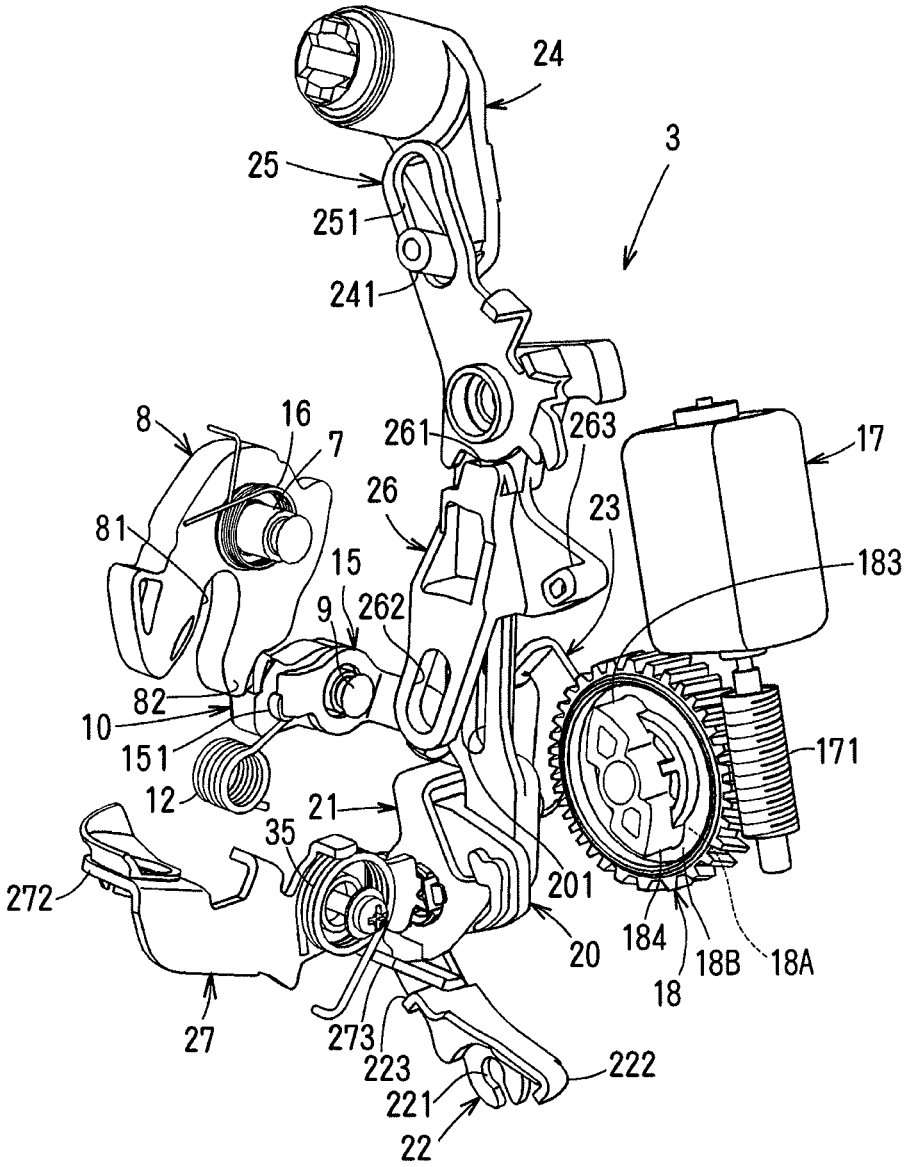
[FIG. 10] A perspective view showing the internal structure of the door latch device.

The coordinating lever 26 is pivoted around the same axis as the second key lever 25 and turns between a locking position in FIG. 8 and an unlocking position in FIG. 9. The coordinating lever 26 has an abutted portion 261 with a predetermined play. Close to the coordinating lever 26 in the second casing part 13B, there is provided a position detecting switch 42 for detecting a locked state and an unlocked state of the coordinating lever 26.

In the lower part of the coordinating lever 26, there is provided an elongate hole 262 coupled to the locking lever 19 and a detected portion 263 at the upper end. The locking and unlocking positions of the coordinating lever 26 are detected with the position detecting switch 42 by getting the abutted portion 263 to abut on or leave the position detecting switch 42 with rotation of the coordinating lever 26.

When the coordinating lever 26 is in the locking position in FIG. 8, the first and second key levers 24,25 turn from the neutral position in an unlocking direction according to unlocking of a key cylinder, so that the second key lever 25 abuts on part of the abutted portion 261 of the coordinating lever 26 to allow the coordinating lever 26 to turn counterclockwise to move to the unlocking position in FIG. 9. When the coordinating lever 26 is in the unlocking position in FIG. 9, the first and second key levers 24,25 turn from the neutral position according to locking of the key cylinder, the second key lever 25 abuts on the other part opposite the part of the abutted portion 261 to allow the coordinating lever 26 to turn to the locking position in FIG. 8.

The locking lever 19 is pivoted on a pivot shaft 29 which extends in a width direction of the vehicle. The pivot shaft 29 is integrally formed with the second casing part 13B between the second casing part 13B and the cover 14. By operating the key cylinder and a locking knob as manually operating means in the interior of the vehicle and turning a worm wheel 18 by a motor, the locking lever 19 turns between the locking position in FIG. 8 where the locking lever 19 abuts a locking stopper 18 of the second casing part 13B and the unlocking position in FIG. 9 where the locking lever 16 abuts a unlocking stopper 136 by turning from the locking position clockwise at a predetermined angle. The locking lever 19 is elastically held in the locking and unlocking positions by force of a spring 43. The tip end of the pivot shaft 29 is fixed on the inner surface of the cover with a tapping screw 38.

In FIGS. 8,9, a coupling portion 193 at the lower end of the locking lever 19 is coupled to the end of a motion-transmitting member 30 such as a cable via which motion of the locking knob can be transmitted. Locking or unlocking of the locking knob allows the locking lever 19 to move to the locking or unlocking position.

Figure 12:
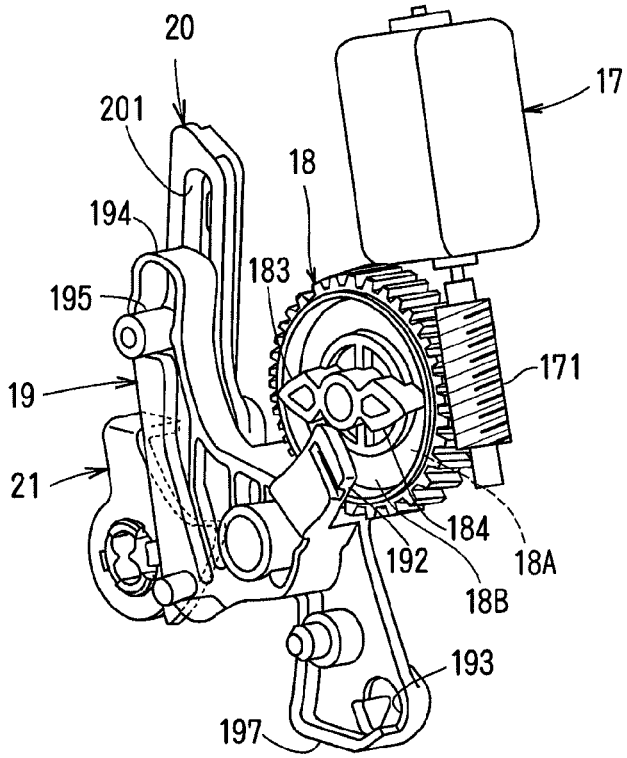
[FIG. 12] A perspective view of the main part of the operational unit.

An upward-extending arm 194 is formed on a locking lever 19. In FIG. 12, a first projection 195 which projects toward the exterior of the vehicle is formed on one side which faces the exterior of the vehicle of the arm 194. The first projection 195 fits in the elongate hole 262 of the coordinating lever 26. The locking lever 19 moves together with the coordinating lever 26 to the locking or unlocking position. When the locking lever 19 and coordinating lever 26 are in the locking position, the key cylinder is unlocked in the exterior of the vehicle, so that the motion is transmitted to the locking lever 19 via the first and second key levers 24,25 and coordinating lever 26. The locking lever 19 turns against the force of the spring 43 from the locking position to the unlocking position. When the locking lever 19 and the coordinating lever are in the locking position, the key cylinder is locked. The motion is transmitted to the locking lever 19 via the first key lever 24, second key lever 25 and coordinating lever 26. The locking lever 19 turns against the force of the spring 43 from the unlocking position to the locking position.

Furthermore, the second projection 196 which projects toward the interior of the vehicle is formed on the side opposite the side on which the first projection 195 of the arm 194 is formed. The second projection 196 slides in the first elongate hole 201 of the first lift lever 20 to allow the locking lever 19 to be connected to the first lift lever 20.

Figure 11:
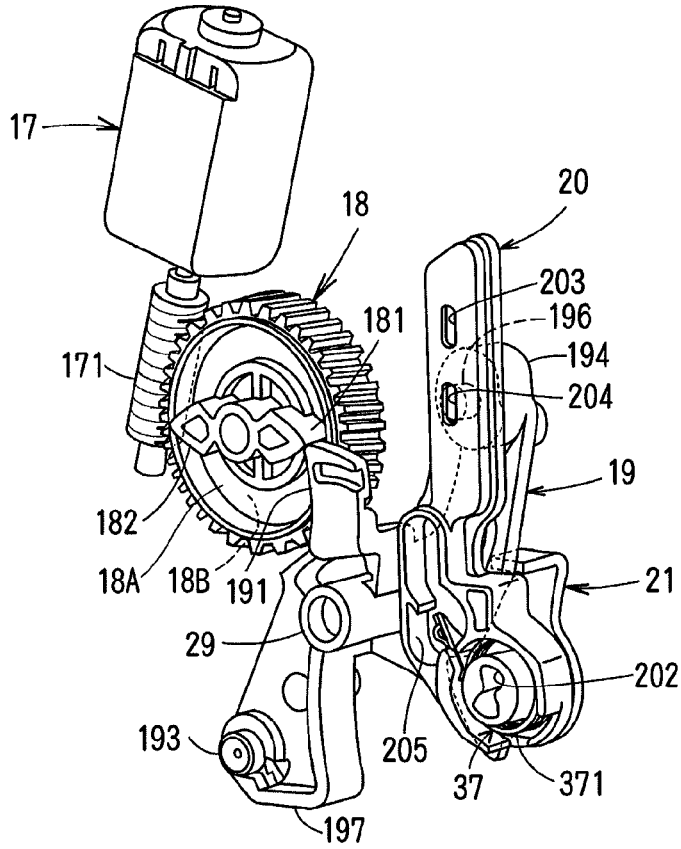
[FIG. 11] A perspective view of the main part of the operational unit.
Figure 13:
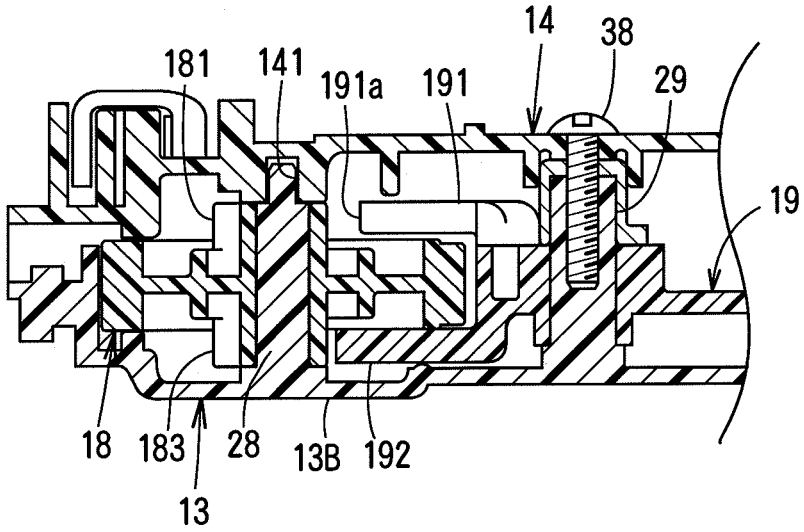
[FIG. 13] An enlarged sectional view taken along the line XIII-XIII in FIG. 3.

First and second engagement arms 191,192 extend away from the pivot shaft 29. In FIGS. 11-13, the first engagement arm 191 and second engagement arm 192 are spaced circumferentially and axially of the pivot shaft 29 such that two rotary surfaces of the worm wheel 18 are held between the first and second engagement arms 191 and 192.

A rotary surface of the first engagement arm 191 closely faces a first rotary surface 18A (surface facing the cover 14) of the worm wheel 18 and the first engagement arm 191 can abut on first engagement projections 181,182 on the first rotary surface 18A of the worm wheel 18. A rotary surface of the second engagement arm 192 closely faces a second rotary surface 18B (surface facing the second casing part 13B) of the worm wheel 18, and the second engagement arm 192 can abut on second engagement projections 183,184 of the second rotary surface of 18B the worm wheel 18. The first and second engagement arms 191,192 are set to the length so as not to cross the axis of rotation of the worm wheel 18 when the locking lever 19 turns from the locking position to the unlocking position and vice versa.

In this embodiment, as mentioned above, both the first and second rotary surfaces 18A, 18B of the worm wheel 18 are held between the first engagement arm 191 which closely faces the first rotary surface 18A of the worm wheel 18 and the second engagement arm 192 which closely faces the second rotary surface 18B of the worm wheel 18. The worm wheel 17 is tilted with respect to the axis of the rotation by force exerting onto the part where the worm 171 meshes with the worm wheel 18 when the worm wheel 18 is forcedly stopped from rotation. By the structure of the worm wheel 18 held between the first and second engagement arms 191 and 192, tilting of the worm wheel 18 with respect to a rotational axis is held down at minimum, which is advantageous in this invention. The advantage is achieved by the first and second rotary surfaces 18A, 18B of the worm wheel 18 in abutment with the first engagement arm 191 and second engagement arm 192.

Furthermore, in this embodiment, as mentioned above, when the locking lever 19 turns from the locking position to the unlocking position and vice versa, the first and second engagement arms 191,192 are set to the lengths so as not to cross the axis of rotation of the worm wheel 18. Thus, the pivot shaft 28 for pivotally mounting the worm wheel 18 to the casing 13 is integrally formed with the casing 13, and the tip end is held on the cover 14, thereby improving the strength of the pivot shaft 28 and mounting the worm wheel 18 to the casing 13 rotationally and securely.

Figure 15:
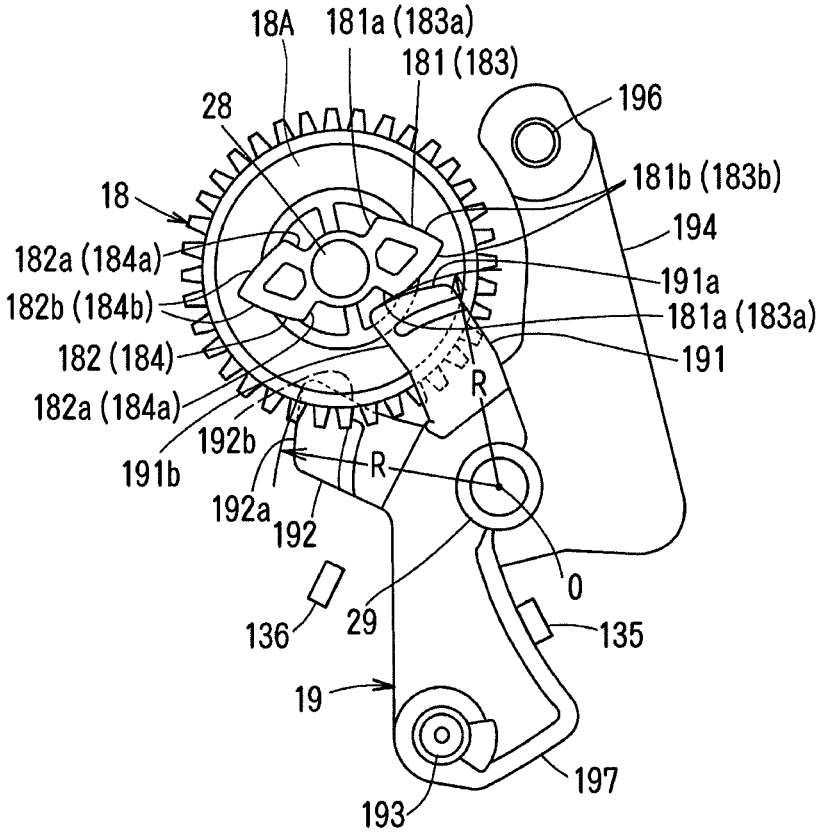
[FIG. 15] A side elevational view of the worm wheel and the locking lever when the locking lever is in the locking position, seen from the interior of the vehicle.
Figure 16:
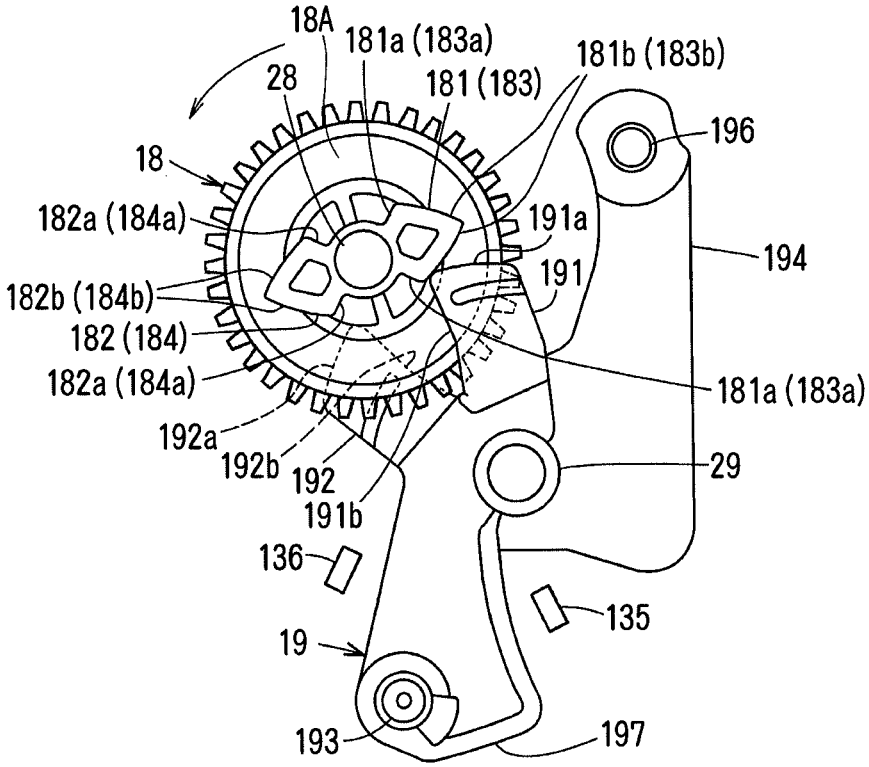
[FIG. 16] A side elevational view of the worm wheel and the locking lever seen from the interior of the vehicle when the locking lever is in an intermediate position.
Figure 17:
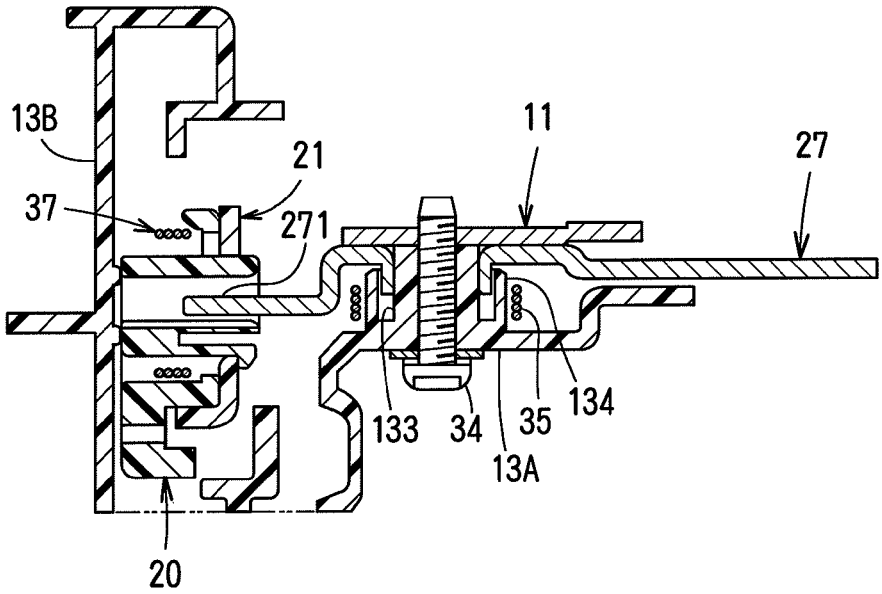
[FIG. 17] An enlarged sectional view taken along the line XVII-XVII in FIG. 2.

As clearly shown in FIGS. 15 and 16, in the first and second engagement arms 191,192 of the locking lever 19, ends 191*a*, 192*a* and inner peripheries 191*b*,192*b* are provided.

The worm wheel 18 is pivotally mounted to a pivot shaft 28 integrally formed with the second casing part 13B between the second casing part 13B and the cover 14. The worm wheel 18 meshes with the worm 171 attached to a rotary shaft of the motor 17 and rotates reversibly with the rotation of the motor 17. In FIG. 13, the pivot shaft 28 engages in a groove 141 of the cover 14 in FIG. 13.

On the first rotary surface 18A (facing the cover 14) of the worm wheel 18, the first engagement projections 181,182 which abut on the first engagement arm 191 of the locking lever 19 are provided, and the second engagement projections 183,184 which abut on the second casing part 13B). The first engagement projections 181,182 and the second engagement projections 183,184 have the same shape and are provided at symmetrical positions of the sides.

The first and second engagement projections 181,182 are provided on the first rotary surface 18A with respect to the center of rotation of the worm wheel 18. The second engagement projections 183,184 are provided on the second rotary surface 18B with respect to the center of rotation of the worm wheel 18.

In each of the engagement projections 181,182,183,184, the width of the rotary surface gradually reduces as it gets away from the pivot shaft 28 and is constricted close to the pivot shaft 28. Thus, in FIGS. 15 and 16, in the engagement projections 181,182,183,184, there are formed constricted portions 181*a*,182*a*,183*a*,184*a* close to the pivot shaft 28 or the center of rotation, and tilted potions 181*b*,182*b*,183*b*, 184*b* which are more separate from the pivot shaft 28 than the constricted portions 181*a*,182*a*,183*a*,184*a*.

In FIG. 8, when the locking lever 19 is in the locking position, the first engagement arm 191 of the locking lever 19 is positioned within a turning path of the first engagement projections 181,182 of the worm wheel 18, while the second engagement arm 192 is positioned out of a turning path of the second engagement projections 183,184. The first engagement projection 181 of the worm wheel 18 abuts on or is close to the end 191*a*, and the first engagement projection 182 is away from the end 191*a* of the first engagement arm 191.

In FIG. 8, when the key cylinder or locking knob is operated for unlocking, the locking lever 19 turns at a predetermined angle from the locking position to the unlocking position clockwise in FIG. 8. In this case, the first and second engagement projections 181,182,183,184 of the worm wheel 18 in the first stop position in FIG. 8 is positioned out of a turning path of the end portions 191*a*,192*a* of the first engagement arms 191,192 of the locking lever 19. Thus, even if the locking lever 19 turns from the locking position to the unlocking position, the first and second engagement arms 191,192 do not abut on the first and second engagement projections 181,182,183,184 although they may slide on them, so that the worm wheel does not reverse with the rotation of the locking lever 19. The key cylinder and locking knob can be unlocked by a weak force without being subjected to resistance for reversing the worm wheel 18 or motor 17.

In the unlocking position in FIG. 9, when the key cylinder or locking knob is operated for locking, the locking lever 19 turns at a predetermined angle from the unlocking position in a direction of locking or counterclockwise and stops in the locking position in FIG. 8. The first and second engagement projections 181,182,183,184 of the worm wheel 18 are positioned out of the turning path of the first and second engagement arms 191,192, so that the worm wheel 18 almost does not turn from the second stop position in FIG. 9 as the locking lever 19 turns from the locking position to the unlocking position. Thus, the key cylinder and locking knob can be operated for unlocking by a weak force.

Then, in FIG. 14, it will be described that the locking lever 19 turns to the lock and unlocking position with turning of the worm wheel 18.

Figure 14:
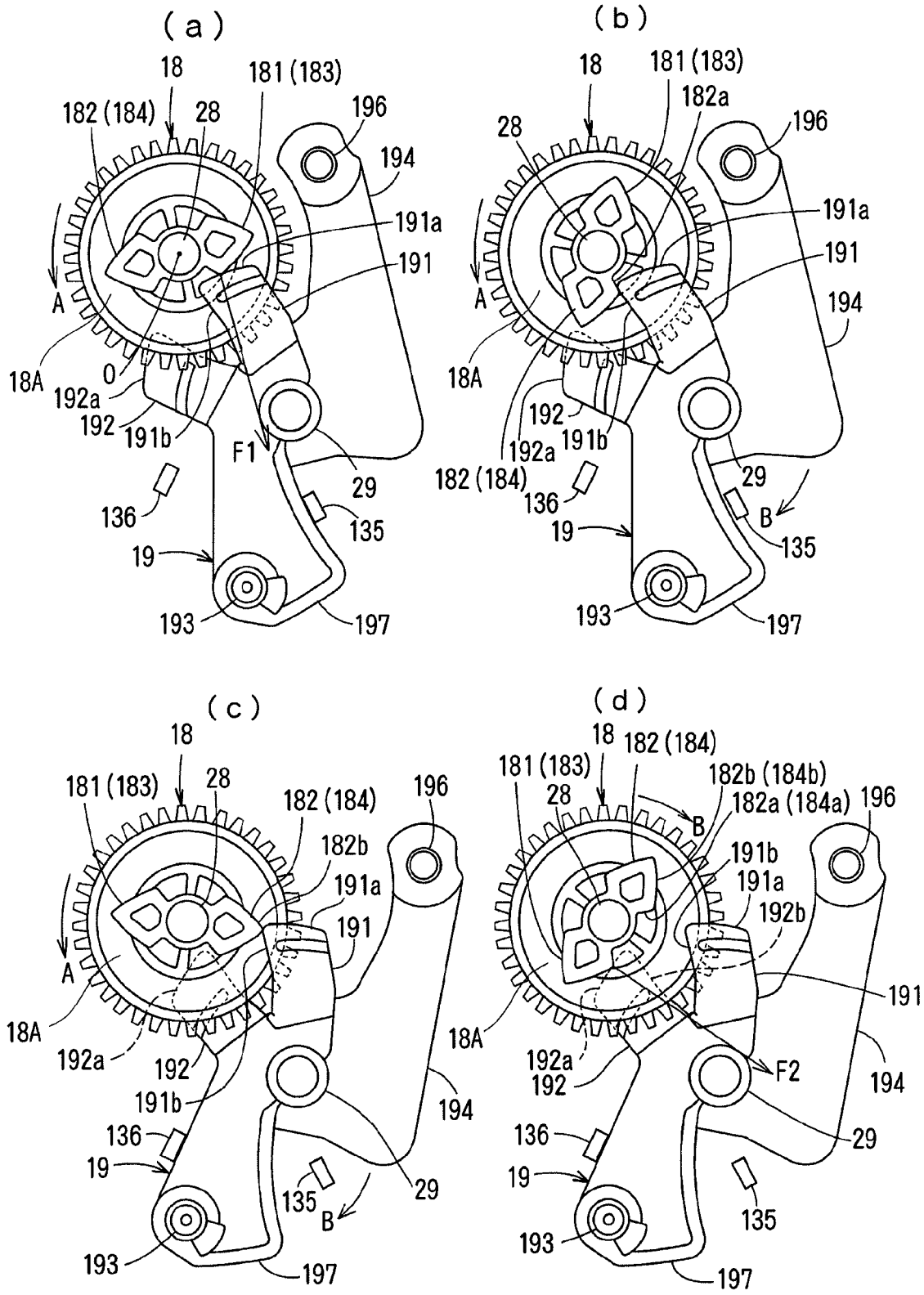
[FIG. 14] A view showing the operation of a worm wheel and a locking lever.

In FIG. 14, the worm wheel 18 and locking lever 19 are only illustrated, but the other elements are omitted. When the locking lever 19 moves to the lock and unlocking positions, the coordinating lever 26, first lift lever 20 and second lift lever 21 move together. However, only in case that a panic occurs as described later, the second lift lever 21 moves to the unlocking position after it stops just before the unlocking position.

FIG. 14(*a*) shows that the locking lever 19 abuts on a locking stopper 135 in the locking position which is the same state as that in FIG. 8.

In the locked state, a switch in the interior of the vehicle or a portable switch is operated to unlock the door, and the motor 17 rotates in an unlocking direction. The worm wheel 18 turns at almost 80 degrees in an unlocking direction from FIG. 14(*a*) or in a direction of an arrow A. In FIG. 14(*b*), a constricting portion 182*a* of the second engagement projection 182 abuts on an inner periphery 191*b* of the first engagement arm 191. The locking lever 19 slightly turns in an unlocking direction from the locked position. Furthermore, the locking lever 19 turns in an unlocking direction from the locking position. In FIG. 14(*c*), a tilted portion 182*b* of the first engagement portion 182*b* of the first engagement portion 182 abuts on an inner periphery 191*b* of the first engagement portion 191 to turn the locking lever 19 in an unlocking direction greatly to abut on an unlocking stopper 136 in the unlocking position. At last, in FIG. 14(*d*), the first engagement portion 182 of the worm wheel 18 leaves the first engagement arm 191 of the locking lever 19, and the second engagement projection 183 abuts on the end 192*a* of the second engagement arm 192. The worm wheel 18 stops at a first stop position and the locking lever 19 abuts on an unlocking stopper 136 and stops at an unlocking position.

In FIG. 14(*d*), the second engagement projection 183 of the worm wheel 18 abuts on the end 192*a* of the second engagement arm 192 and the worm wheel 18 forcedly stops. A force for tilting the worm wheel 18 with respect to a rotation axis exerts on an engaging portion between the worm 171 and the worm wheel 18. But tilting of the worm wheel 18 is held down by abutment of the first and second engagement arms 191,192 of the locking lever 18 with the rotary surface of the worm wheel 18.

In the unlocked state in FIG. 14(*d*), when the switch is operated for locking, the motor 17 turns in a direction of locking and the worm wheel 18 turns in a locking direction as shown in an arrow B opposite an unlocking direction. Following the constricting portion 184*a* of the second engagement projection 184 of the worm wheel 18, the tilted portion 184*a* abuts on the inner periphery 192*b* of the second engagement arm 192. FIG. 14(*a*), the tilted portion 181*b* of the first engagement projection 181 abuts on the end 191*a* of the first engagement arm 191 of the locking lever 19, so that the worm wheel 18 stops at the second stop position, the locking lever 19 stops at the second stop position, and the locking lever 19 abuts on the locking stopper 135 and stops at the second locking position.

In FIG. 14(*a*), when the first engagement projection 181 of the worm wheel 18 abuts on the end 191*a* of the first engagement arm 191 of the locking lever 19 and the worm wheel 18 stops forcedly from rotation. A force for tilting the worm wheel 18 toward the axis of rotation exerts onto the engagement portion of the worm 171 with the worm wheel 18. In spite of the force, tilting of the worm wheel 18 is held down by abutment of the first and second engagement arms 191,192 with the rotary surface of the worm wheel 18.

In this embodiment, with the rotation of the worm wheel 18 by the motor 18, the locking lever 19 turns securely to the unlocked or locking position.

The end 191*a* of the first engagement arm 191 is determined such that the line of action of force to the locking lever 19 by the first engagement projection 181 or 182 becomes a direction for turning to the locking position when the locking lever 19 turns in a direction of locking in case that the first engagement projection 181 or 182 of the worm wheel 18 abuts on the end 191*a* of the first engagement arm 191 of the locking lever 19. Furthermore, the end 192*a* of the second engagement arm 192 is determined in shape such that the line of action of force from the second engagement projection 183 or 184 to the locking lever 19 becomes a direction of turning to the unlocking position when the locking lever turns in a direction for unlocking in case that the second engagement projection 183 or 184 abuts on the end 192*a* of the second engagement arm 192.

Describing the foregoing structure concretely with respect to FIG. 15, the end 191*a* of the first engagement arm 191 of the locking lever 19 is formed such that the distance R from a pivot axis O of the locking lever 19 gradually reduces clockwise, and the end 192*a* of the second engagement arm 192 is formed such that a distance R from a pivot axis O of the locking lever 19 gradually reduces counterclockwise.

From the unlocked state in FIG. 14(*d*) to the locked state in FIG. 14(*a*), the first engagement portion 181 of the worm wheel 18 abuts on the end 191*a* of the first engagement arm 191 of the locking lever 19. In FIG. 14(*a*), the line of action F1 from the first engagement projection 181 to the locking lever 19 becomes a direction for turning the locking lever 19 counterclockwise or in a locking direction to turn the locking lever 19 securely until the locking lever 19 abuts on the locking stopper 135. Its illustration is omitted, and when the first engagement projection 191*a* of the worm wheel 18 abuts on the end 191*a* of the first engagement arm 191 of the locking lever 19, the line F1 of action of the force for turning the locking lever 19 counterclockwise or in a locking direction exerts onto the locking lever 19 from the first engagement projection 182.

From the locked state in FIG. 14(*a*) to the unlocked state in FIG. 14(*d*), the second engagement projection 183 of the worm wheel 18 abuts on the end 192*a* of the second engagement arm 192 of the locking lever 19, and the line F2 of action of force from the second engagement projection 183 to the locking lever 19 becomes a direction for turning the locking lever 19 clockwise or in an unlocking direction, so that the locking lever 19 can turn securely to the unlocking position where the locking lever 19 abuts on the unlocking stopper 136. When the second engagement projection 184 of the worm wheel 18 abuts on the end 191*a* of the second engagement arm 192 of the locking lever 19, the line F2 of action of force for turning the locking lever 19 clockwise or in an unlocking direction extends from the second engagement projection 184 to the locking lever 19.

Furthermore, in this embodiment, the locking lever 19 can turn in the locking or unlocking position by turning the worm wheel 18 by the motor 17 even if the locking lever 19 stops between the locking and unlocking positions in FIG. 16 owing to insufficiency in operation stroke with unlocking and locking of the key cylinder and locking knob.

As mentioned above, the foregoing structure is achieved by sharpening the engagement projections 181,182 of the worm wheel 18. Not only in case that the locking lever 19 is in the locking and unlocking positions, but also in case that the locking lever 19 is between the locking and unlocking positions, either the first engagement projections 181,182 or second engagement projections 183,184 of the worm wheel 18 can abut on the inner periphery 191*b* of the first engagement arm 191 or inner periphery 192*b* of the second engagement arm 192. As clearly understood from FIG. 16, when the locking lever 19 is between the locking and unlocking positions, the worm wheel 18 turns in a direction of an arrow or counterclockwise, a tilted portion 184*b* of the second engagement projection 184 of the worm wheel 18 abuts on the inner periphery 191*b* of the locking arm 191 to allow the locking lever 19 to turn from the intermediate position to the unlocking position. From FIG. 16, the locking lever 19 is actuated in a locking direction or counterclockwise, and the line of action of force by contacting the end 191*a* of the first engagement portion 191*a* of the first engagement portion 191 with the tilted portion 181*a* of the first engagement projection 181 is not directed toward the pivot shaft 29 of the locking lever 19. Thus, the worm wheel 18 turns in a direction of an arrow or counterclockwise to allow the locking lever 18 to turn.

The outside lever 27 is pivotally mounted to a cylindrical pivot shaft 133 integrally formed with the lower part of the first casing part 13A, and is held between the end of an annular portion 134 and the back plate 11 around the pivot shaft 133 not to loosen axially. The pivot shaft 133 is connected to the back plate 11 with a tapping screw 34 put in from the outside for the casing 13 thereby improving rigidity of the pivot shaft 133 and pivoting the outside lever 27 to the first casing part 13A securely.

The outside lever 27 comprises a vehicle-inside connecting portion 271 and a vehicle-outside connecting portion 272 at the ends. The first and second lift levers 20,21 are coupled to the vehicle-inside connecting portion 271 flexibly at a predetermined angle. An outside handle on the door outside the vehicle is connected to the vehicle-outside connecting portion 272 via a vertical motion-transmitting member (not shown). When the outside handle is operated to open the door, the outside lever 27 turns from the standby position in FIG. 2 clockwise or in an opening direction at a predetermined angle.

Under the vehicle-inside connecting portion 271 of the outside lever 27, there is provided a released abutment portion 273 which abuts on a releasing abutment portion 223 of the inside lever 22.

Figure 18:
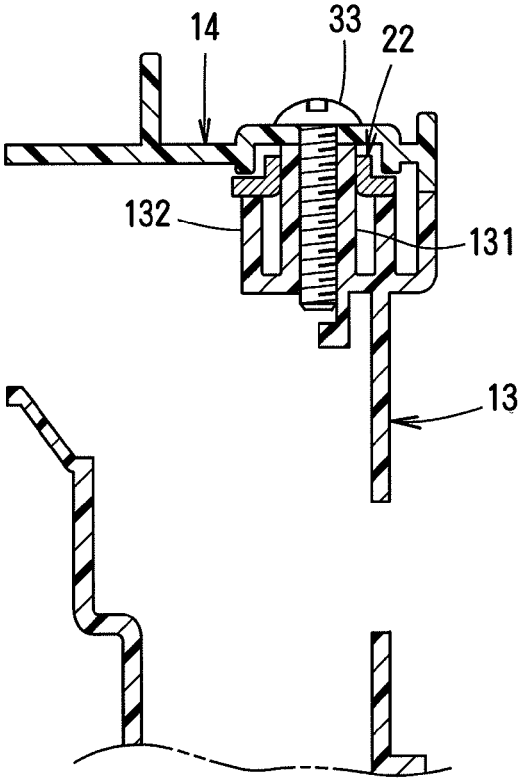
[FIG. 18] An enlarged sectional view taken along the line XVIII-XVIII in FIG. 3.

The inside lever 22 is pivotally mounted to a cylindrical pivot shaft 131 integrally formed with the second casing part 13B. Further describing the pivoting structure in FIG. 18, the inside lever 22 is pivotally mounted to the pivot shaft 131 and is held not to loosen axially between the cover 14 and the end of an annular portion 132 around the pivot shaft 131 of the second casing part 13B.

The pivot shaft 131 is connected to the cover 14 with the tapping screw 33 which is put from the outside of the casing 13, thereby improving rigidity of the pivot shaft 132 and pivotally mounting the inside lever 22 to the second casing part 13B securely.

To a coupling portion 221 at the lower end of the inside lever 22 is coupled a motion-transmitting member 32 via which motion of the inside handle (not shown) inside the vehicle can be transmitted. Thus, when the inside handle is operated to open the door, the inside lever 22 turns in an opening direction or clockwise from the standby position in FIGS. 8 and 9 at a predetermined angle.

The inside lever 22 comprises the releasing abutment portion 223 which abuts on the released abutment portion 273. Thus, when the inside lever 223 is operated to open the door, the inside lever 22 turns from the standby position in the direction of opening the door.

Figure 19:
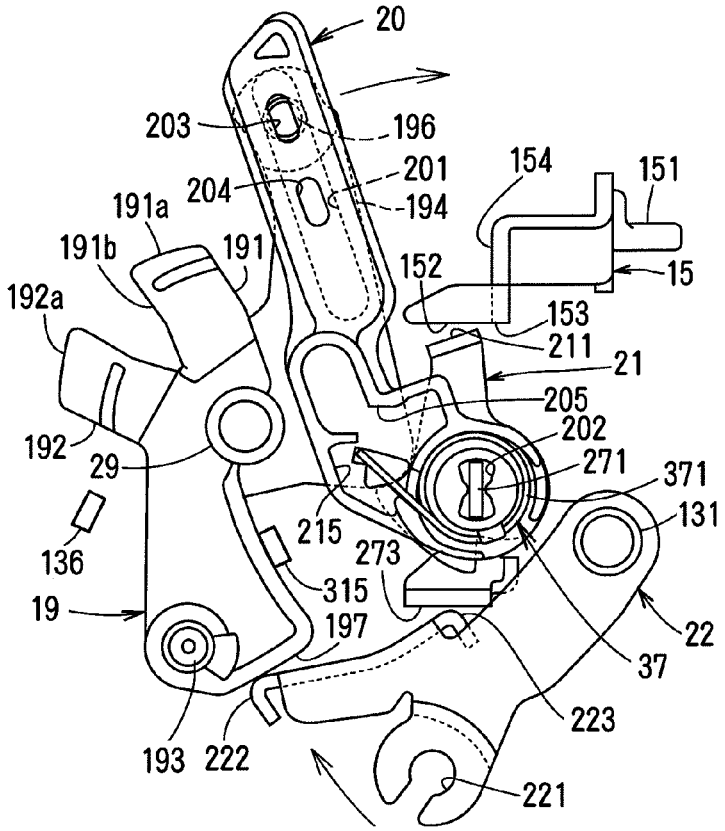
[FIG. 19] A first view showing the operation of an inside lever.

The inside lever 22 has an abutment portion 222 which faces an abutted portion 187 at the lower end of the locking lever 19. When the inside handle is operated to open the door in FIG. 8, the inside lever 22 turns from the standby position in a direction of opening the door, and the abutment portion 222 directly comes in contact with the abutted portion 197 of the locking lever 19 in FIG. 19. Thus, right after the locking lever 19 forcedly turns from the locking position to the unlocking position in FIG. 20, the releasing abutment portion 223 of the inside lever 22 abuts on the released abutment portion 273 of the outside lever 27 thereby turning the outside lever 27 from the standby position in a direction of opening the door. As a result, even if the locking lever 19 is in the locking position or even if the door latch device 1 is in the locked state, the door latch device 1 is shifted to the unlocked state by operating the inside handle to open the door, thereby opening the door.

The vehicle-inside connecting portion 271 of the outside lever 27 is inserted in a drum-like hole 202 at the lower end of the first lift lever 20, so that the first lift lever 20 is pivotally mounted in a longitudinal direction of the vehicle around the vehicle-inside connecting portion 271.

A first vertically elongate hole 201 is formed at the side nearer to the outside of the vehicle of the first lift lever 20. A second projection 196 of the locking lever 19 slides vertically in the first elongate hole 201. The locking lever 19 turns from the locking position to the unlocking position or vice versa, so that the first lift lever 20 turns with the locking lever 19 from the locking position in FIG. 8 to the unlocking position in FIG. 9. The outside lever 27 turns from the standby position in a direction of opening the door. Thus, the first lift lever 20 turns moves upward from the locking position when the locking lever 19 is in the locking position, and moves upward from the unlocking position when the locking lever 19 is in the unlocking position.

In the first elongate hole 201, there are formed two confirmation windows 203,204 which go through in the width direction of the vehicle. Through the confirmation windows 203,204, in assembling steps, an operator can confirm from the outside whether or not the second projection 196 of the locking lever 19 engages in the first elongate hole 201 of the first lift lever 20 securely.

The upper confirmation window 203 corresponds to the second projection 196 in position when the locking lever 19 and first lift lever 29 are in the locking position. The lower confirmation window 204 corresponds to the second projection 196 in position when the first lift lever 20 is in the unlocking position.

At the side of the first lift lever 20 facing the inside of the vehicle, a second elongate hole 205 having an L-shape is formed under the first elongate hole 201. An engagement portion 231 of the canceling lever 23 slides in the second elongate hole 205 vertically and longitudinally of the vehicle. The second elongate hole 205 does not overlap the first elongate hole 201 and is positioned below, thereby reducing thickness of the first lift lever 20 along the width of the vehicle.

The second lift lever 21 is movable together with the first lift lever 20 between the locking position in FIG. 8 and the unlocking position in FIG. 9 on the vehicle-inside connecting portion 271 of the outside lever 27 or on the same axis as the first lift lever 20 by force of the spring 37 provided between the first lift lever 20 and the second lift lever 21. When the outside lever 27 turns from the standby position in a direction of opening the door, the second lift lever 21 moves upward with the first lift lever 20.

The spring 37 engages with the first lift lever 20 at one end, and with the second lift lever 21 at the other end. Clockwise force is applied to the second lift lever 21 in FIGS. 8 and 9 with respect to the first lift lever 20. The second lift lever 21 abuts on a limiting portion 200 of the first lift lever 20 and is held in ordinary positions in FIGS. 8 and 9.

The second lift lever 21 has a releasing portion 211 which abuts on the released portion 153 of the opening lever 15. Thus, the second lift lever 21 moves upward with the first lift lever 20 to allow the releasing portion 211 to abut on the released portion 153, so that the opening lever 15 turns from the standby position in the direction of opening the door to release the ratchet 10 from the latch 8 thereby opening the door. But when the second lift lever 21 moves with the first lift lever 20 upward from the locking position, the releasing portion 211 swings without touching the released portion 153, and the opening lever 15 does not turn, so that the door cannot be opened.

Figure 21:
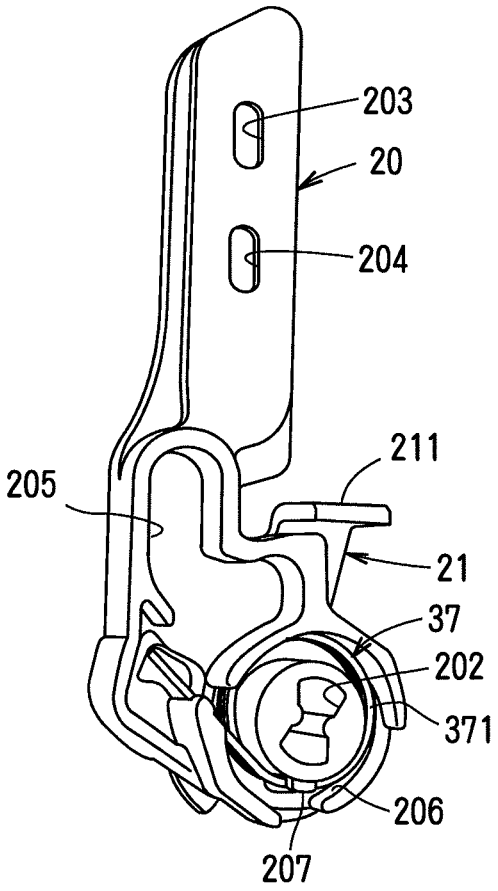
[FIG. 21] A perspective view of first and second lift levers seen from the interior of the vehicle.
Figure 22:
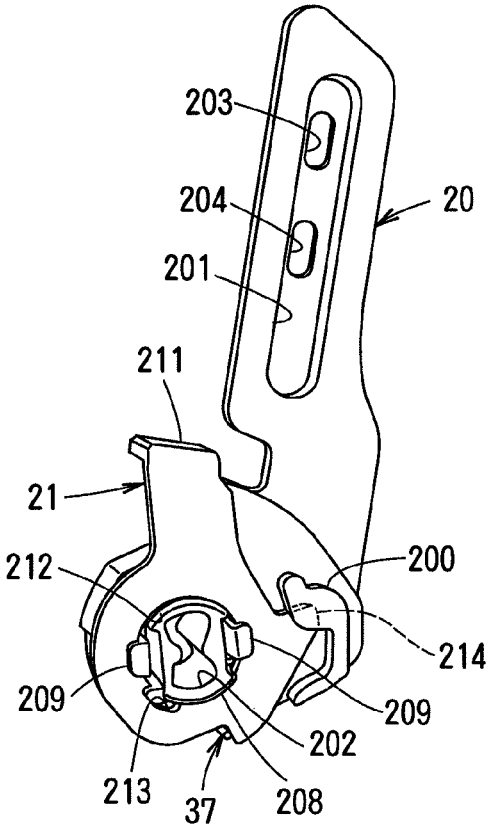
[FIG. 22] A perspective view of the first and second lift levers seen from the exterior of the vehicle.
Figure 23:
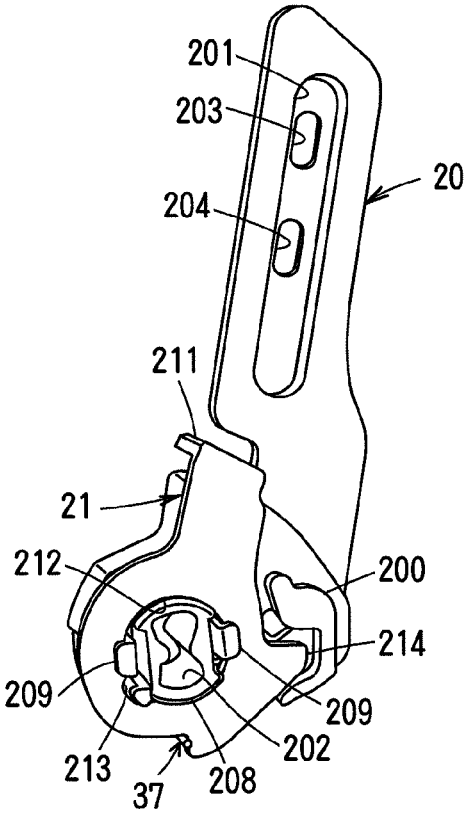
[FIG. 23] A perspective view of the first and second lift levers seen from the interior of the vehicle when they are connected.
Figure 24:
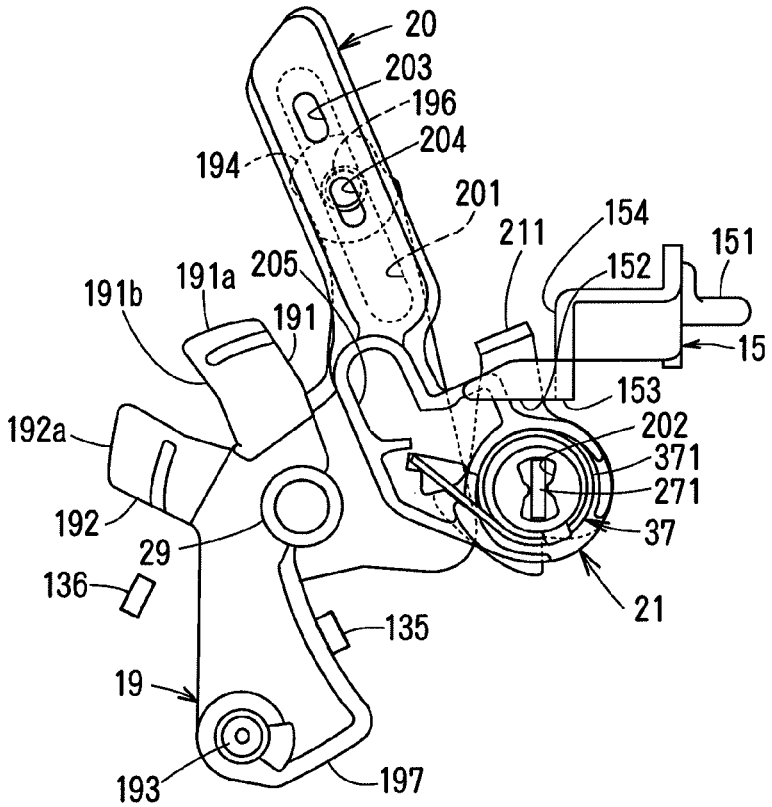
[FIG. 24] A first view of the main part when a panic occurs.

This embodiment provides the structure with improved connection and more reliable operation of the first lift lever 20 with the second lift lever 21 and spring 37. As shown in FIGS. 21-23, the structure comprises a circumferential groove 206 for receiving a coil 371 of the spring 37 around the hole 202 at one side facing the inside of the vehicle; a pawl 207 at the circumferential groove for preventing the coil 371 from taking off the circumferential groove 206; a cylindrical shaft 208 pivotally disposed in a circular hole 212 of the second lift lever 21 around a hole 202 of the first lift lever 20; an engagement portions 209,209 of the cylindrical shaft 208 to prevent the second lift lever 21 from taking off the cylindrical shaft 208; and a limiting portion 200 on the first lift lever 20 in which the engagement portion 214 of the second lift lever 21 engages. The circular hole 212 of the second lift lever 21 has a notch 123. When the cylindrical shaft 208 of the first lift lever 20 is connected in the circular hole 212, the engagement portion 209 of the first lift lever 20 passes through the notch 213.

As shown in FIG. 21, the coil 371 of the spring 37 is disposed in the circumferential groove 206 of the first lift lever 20. The pawl 207 engages with the coil 371 to enable the spring 378 to be connected in the first lift lever 20 provisionally thereby improving connection of the spring 37.

Furthermore, in FIGS. 22,23, when the cylindrical shaft 208 of the first lift lever 20 is disposed in the circular hole 212 of the second lift lever 21, the engagement portions 209,209 engages with the surrounding of the circular hole 212, so that the second lift lever 21 is not easily removed from the cylindrical shaft 208. Thus, the first lift lever 20 can be connected to the second lift lever 21 provisionally in advance, thereby achieving the connection of the first lift lever 20 and second lift lever 21 to the outside lever 27 more effectively.

In FIG. 22, when the force of the spring 37 exerts the second lift lever 21, the engagement portion 214 of the second lift lever 21 abuts on the limiting portion 200 of the first lift lever 20 so that the second lift lever 21 stops in an ordinary position and engages with the limiting portion 200 to control axial loosening of the second lift lever 21. Thus, the second lift lever 21 is held in the ordinary position and turns together with the first lift lever 20 within the force of the spring 37 so as to move in the locking and unlocking positions securely.

The canceling lever 23 is disposed between the second casing part 13B and the cover 14 and pivotally mounted on the pivot shaft 36 supported by the cover 14 and extending along the width of the vehicle. At the lower end of the canceling lever 23, there is provided an engagement portion 231 which slides in a second elongate hole 205 of the first lift lever 20, and at the upper part of the canceling lever, there is provided a canceled portion 232 which abuts on the canceling portion 152 of the opening lever 15.

In FIG. 8, when the first lift lever 20 is in the locking position, the canceled portion 232 of the canceling lever 23 faces the canceling portion 152 of the opening lever 15 closely and is capable of abutting. When the first lift lever 20 is in unlocking position, the canceled portion 232 is spaced from the canceling portion 152 and is not capable of abutting.

By the foregoing structure, a locking knob is operated for locking when the door is open. Then, the door is closed and unlocked with canceling of the locking. With turning of the latch 8 when the door is closed, the ratchet 10 and opening lever 15 turn from the standby position in a direction of opening the door, so that the canceling portion 152 of the opening lever 15 abuts on the canceled portion 232 of the canceling lever 23. Thus, the canceling lever 23 turns counterclockwise from FIG. 8, and the engagement portion 231 abuts on a straight portion of the second elongate hole 205 to enable the first lift lever 20 to move from the locking position to the unlocking position. With this motion, the second lift lever 21, locking lever 19 and coordinating lever 26 move to the unlocking position.

The locking knob is operated for locking while the door is open and the door is closed while the outside handle is operated for opening the door. The locking is not canceled. That is to say, according to opening operation of the outside handle, the outside lever 27 turns in a direction of opening the door. When the first lift lever 20 moves upward from the locking position, the engagement portion 231 of the canceling lever 23 moves to a wider part of the second elongate hole 205 of the first lift lever 20. Thus, even when the door is closed and the canceling lever 23 turns counterclockwise from FIG. 8, the engagement portion 231 of the canceling lever 23 merely moves in the wider portion of the second elongate hole 205, so that the motion of the engagement portion 231 is not transmitted to the first lift lever 20. So the first lift lever 20 is still kept in the locking position.

The operation of one embodiment according to the present invention will be described as below.

When the Outside Handle and Inside Handle are Operated to Open the Door in an Unlocked State When the door latch device 1 is in an unlocked state, the locking lever 19, first and second lift levers 20,21 and coordinating lever 26 are placed in the unlocking position. When the outside handle is operated to open the door, the outside lever 27 turns from the standby position against force of the spring 35 in the direction of opening the door to allow the vehicle-inside connecting portion 271 to move upward, so that the first and second lift levers 20,21 move upward from the unlocking position. The releasing portion 211 of the second lift lever 21 abuts on the released portion 153 of the opening lever 15 to turn the ratchet 10 and opening lever 15, so that the ratchet 10 leaves the latch 8 and the door can be opened.

When the door latch device 1 is in the unlocked state, the inside handle is operated to open the door, and the inside lever 22 turns from the standby position to allow the releasing abutment portion 223 of the inside lever 22 to abut on the released abutment portion 273 of the outside lever 27, so that the outside lever 27 turns from the standby position against the spring 35 in the direction for opening the door. Thus the door can be opened as the outside handle is operated to open the door.

When the Outside Handle is Operated in the Locked State

When the door latch device 1 is in the locked state in FIG. 8, the locking lever 19, first and second lift levers 20,21 and coordinating lever 26 are in the locking positions, and the releasing portion 211 of the second lift lever 21 cannot abut on the released portion 153 of the opening lever 15. With the opening operation of the outside handle, even when the outside lever 27 turns to allow the first and second lift levers 20,21 to move upward, the releasing portion 211 of the second lift lever 21 does not abut on the released portion 153 of the opening lever 15, so that the opening lever 15 and ratchet 10 do not turn in the direction for opening the door. Thus, in the locked state, the door cannot be opened with the outside handle.

When the Inside Handle is Operated in the Locked State

When the door latch device 1 is in the locked state, the inside handle is operated in the interior of the vehicle. The motion of the inside handle is transmitted to the inside lever 22 via the motion transmitting member 32. The inside lever 22 turns from the standby position around the pivot shaft 131 in the direction for opening the door, and in FIG. 19, the abutment portion 222 of the inside lever 222 directly abuts on the abutted portion 197 of the locking lever 19 in the locking position. Thus, a force for turning the locking lever 19 from the locking position to the unlocking position exerts on the locking lever 19, and the locking lever 19 turns at a predetermined angle. The forcing direction of the spring 43 is reversed to allow the locking lever 19 to turn toward the unlocking position. At the same time, the abutment portion 222 of the inside lever 22 leaves the abutted portion 197 of the locking lever 19, and the releasing abutment portion 223 abuts on the released abutment portion 273 of the outside lever 27, so that the outside lever 27 turns against the force of the spring 35 from the standby position in the direction for opening the door. Thus, the first and second lift levers 20,21 move upward from the unlocking position. The releasing portion 211 of the second lift lever 21 abuts on the released portion 153 of the opening lever 15, so that the ratchet 10 and opening lever 15 turn in the direction for opening the door. The ratchet 10 leaves the latch 8, and the door can be opened. When the inside handle is operated to open the door in the interior of the vehicle, the locked state is shifted to the unlocked state and the door is opened.

When the Key Cylinder is Operated for Unlocking in the Locked State

Unlocking by the key cylinder is transmitted to the first key lever 24 thereby turning the first key lever 24 clockwise from a neutral position, which is transmitted to the second key lever 25 via the projection 241 of the first key lever 24 and the elongate hole 251 of the second key lever 25, which turns around the pivot shaft 31 counterclockwise from a neutral position in FIG. 8. It is transmitted to the coordinating lever 26 via the abutted portion 261.

The coordinating lever 26 turns around the pivot shaft 31 from the locking position to the unlocking position, which is transmitted to the locking lever 19 via the elongate hole 262 of the coordinating lever 26 and the projection 195 of the locking lever 19. The locking lever 19 turns around the pivot shaft 29 from the locking position to the unlocking position, which is transmitted to the first lift lever 20 via the projection 196 of the locking lever 19 and the first elongate hole 201 of the first lift lever 20.

The first and second lift levers 20,21 turn around the vehicle-inside connecting portion 271 of the outside lever 27 from the locking position to the unlocking position. After each of the levers moves to the unlocking position, the first and second lift levers 24,25 return to the neutral position. By pulling the key out of the key cylinder, it becomes the unlocked state in FIG. 9.

In this case, the first and second engagement projections 181,182,183,184 of the worm wheel 18 in the first stop position are positioned out of the turning path of the first and second engagement arms 191,192 of the first locking lever 19. The first and second engagement arms 191,192 merely move along the rotary surface of the worm wheel 18, and the rotation of the locking lever 19 is not transmitted to the worm wheel 18. Unlocking by the locking knob is carried out by a weak force without reversing the worm wheel 18 or motor 17.

The Key Cylinder is Operated for Locking in the Unlocked State

Locking by the key cylinder is transmitted to the first key lever 24. The first key lever 24 turns counterclockwise from the neutral position in FIG. 9, which is transmitted to the second key lever 25 via the projection 241 of the first key lever 24 and the elongate hole 251 of the second key lever 25.

The second key lever 25 turns around the pivot shaft 31 from the neutral position in FIG. 9 clockwise, which is transmitted to the coordinating lever 26 via the abutted portion 261. Thus, the coordinating lever 26 turns around the pivot shaft 31 from the unlocking position to the locking position, which is transmitted to the locking lever 19 via the elongate hole 262 of the coordinating lever 26 and the first projection 195 of the locking lever 19, which turns around the pivot shaft 29 from the unlocking position to the locking position. It is transmitted to the first lift lever 20 via the second projection 196 of the locking lever 19 and the first elongate hole 201 of the first lift lever 20. The first and second lift levers 20,21 turn from the unlocking position to the locking position around the vehicle-inside connecting portion 271 of the outside lever 27. After each lever is moved to the locking position, the first and second key levers 24,25 are returned to the neutral position. By pulling the key out of the key cylinder, it becomes the locked state in FIG. 8.

Even in this case, the first and second engagement projections 181,182,183,184 of the worm wheel 18 in the second stop position are positioned out of the turning path of the first and second engagement arms 191,192 of the locking lever 19. Thus, the first and second engagement arms 191,192 of the locking lever 19 merely move along the rotary surface of the worm wheel 18, and the rotation of the locking lever 19 is not transmitted to the worm wheel 18. Locking of the locking knob can be achieved by a weak force without reversing the worm wheel 18 or motor 17.

The Locking Knob is Operated for Locking in the Unlocked State

Locking by the locking knob is transmitted to the locking lever 19 via the motion transmitting member 30. The locking lever turns from the unlocking position in FIG. 9 to the locking position in FIG. 8, and the coordinating lever 26 and first and second lift levers 20,21 move from the unlocking position to the locking position.

In this case, the first and second engagement projections 181,182,183,184 of the worm wheel 18 in the second stop position are out of the turning path of the first and second engagement arms 191,192 of the locking lever 19. The first and second engagement arms 191,192 of the locking lever 19 merely move along the rotary surface of the worm wheel 18, and the rotation of the locking lever 19 is not transmitted to the worm wheel 18. Locking by the locking knob can be achieved by weak force without reversing the worm wheel 18 or motor 17.

When the Locking Knob is Operated for Unlocking in the Locked State

Unlocking by the locking knob is transmitted to the locking lever 19 via the motion transmitting member 30. The locking lever 19 turns from the locking position in FIG. 8 to the unlocking position in FIG. 9. With the rotation, the coordinating lever 26, and first and second lift levers 20,21 move from the locking position to the unlocking position.

In this case, the first and second engagement projections 181,182,183,184 of the worm wheel 18 in the first stop position are out of the turning path of the first and second engagement arms 191,192 of the first locking lever 19. The first and second engagement arms 191,192 of the locking lever 19 merely move along the rotary surface of the worm wheel 18, and the rotation of the locking lever 19 is not transmitted to the worm wheel 18. Unlocking by the locking knob is achieved by a weak force without reversing the worm wheel 18 or motor 19.

When the Switch is Operated for Locking in the Unlocked State

When a switch is operated for locking to rotate the motor 17 in the locking direction, the worm wheel 18 turns clockwise around the pivot shaft 28 from the position in FIG. 9. And the worm wheel 18 turns at about 45 degrees clockwise, the second engagement projection 183 of the worm wheel 18 abuts on the inner periphery 192*b* of the second engagement arm 192 of the locking lever 19, and the locking lever 19 turns counterclockwise from the unlocking position.

When the locking lever 19 turns to the locking position, the first engagement projection 182 of the worm wheel 18 abuts on the end 191*a* of the first engagement arm 191 of the locking lever 19, so that the worm wheel 18 stops turning. Following the turning of the locking lever from the unlocking position to the locking position, the first and second lift levers 20,21 and coordinating lever 26 move from the unlocking position to the locking position and become the locked state.

When the Switch is Operated for Unlocking in the Locked State

When the switch is operated for unlocking, the motor turns in a direction of unlocking, and the worm wheel 18 turns counterclockwise around the pivot shaft 28 from the position in FIG. 8. And the worm wheel turns counterclockwise at about 90 degrees, and in FIG. 14(*b*), the first engagement projection 182 of the worm wheel 18 abuts on the inner periphery 191*b* of the first engagement arm 191 of the locking lever 19, so that the locking lever 19 turns clockwise from the locking position.

Figure 20:
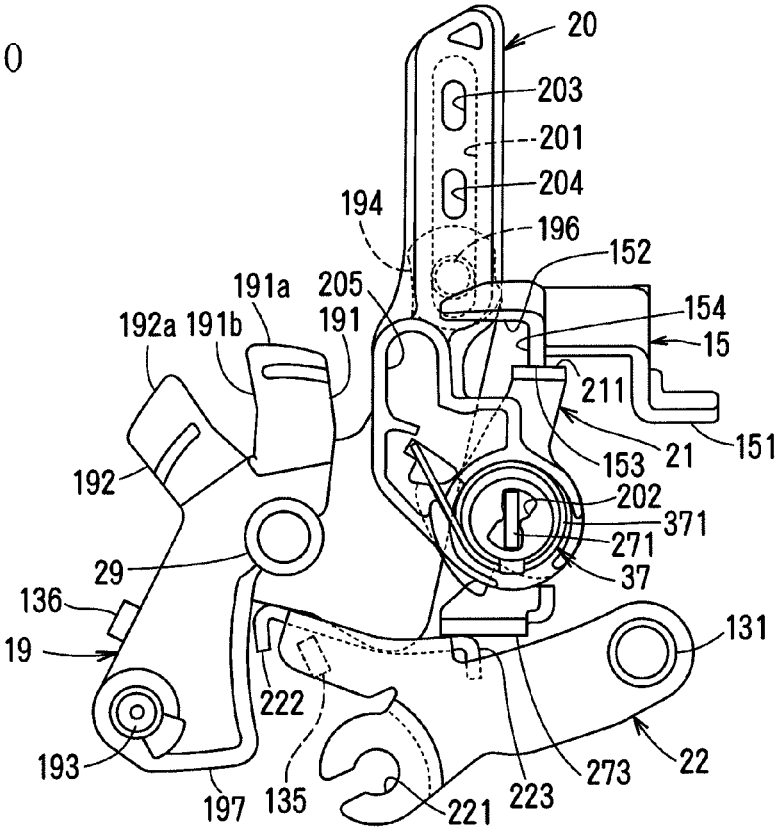
[FIG. 20] A second view showing the operation of the inside lever.

The locking lever 19 turns to the unlocking position in FIGS. 9 and 14(*b*) via FIG. 20(*c*), and the second engagement projection 183 of the worm wheel 18 abuts on the end 192*a* of the second engagement arm 19, and the worm wheel 18 stops turning. When the locking lever 19 turns from the locking position to the unlocking position and the first and second lift levers 20,21 and coordinating lever 26 move from the locking position to the unlocking position.

Figure 25:
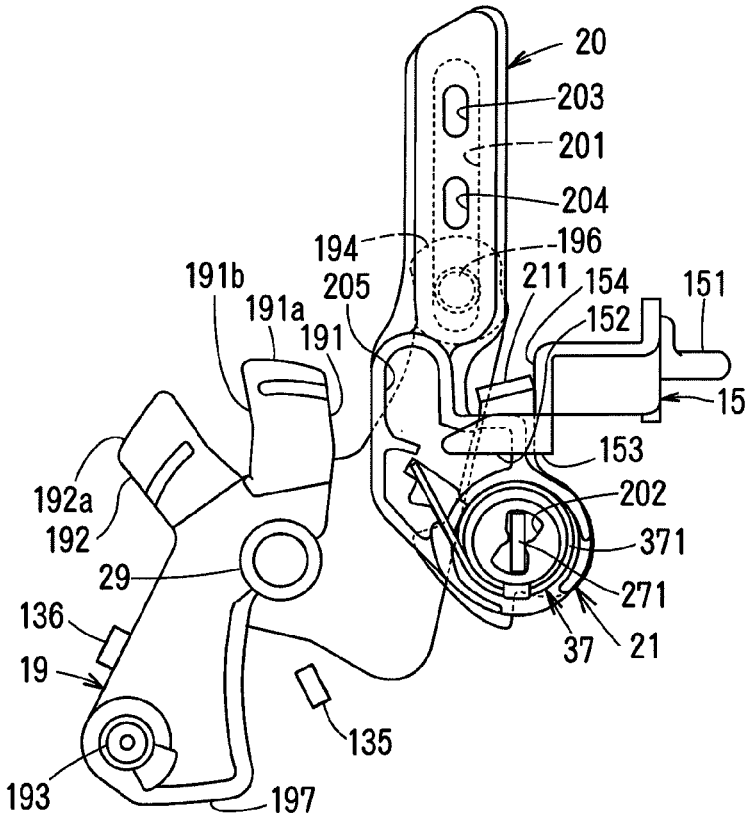
[FIG. 25] A second view of the main part when the panic occurs.

When the Switch is Operated for Unlocking Just After the Outside Handle or Inside Handle is Operated to Open the Door in Locked State, or When a Panic Takes Place When the door latch device 1 is in the locked state, the outside handle (or the inside handle) is operated to open the door, the outside lever 27 turns in a direction of releasing. The releasing portion 211 of the second lift lever 21 swings without abutment with the released portion 153 of the opening lever 15 from the locking position, and the first and second left levers 20,21 are in an upward-moving state. Right after it, the switch is operated for unlocking, and with rotation of the motor 17 and the worm wheel 18, the locking lever 19 turns from the locking position in the direction of unlocking. In FIG. 25, the second lift lever 21 abuts on the opening lever 15. While the second lift lever 21 still remains right after the unlocking position, with the rotation of the locking lever 19, the first lift lever 18 turns against force of the spring 37 to the unlocking position.

Figure 26:
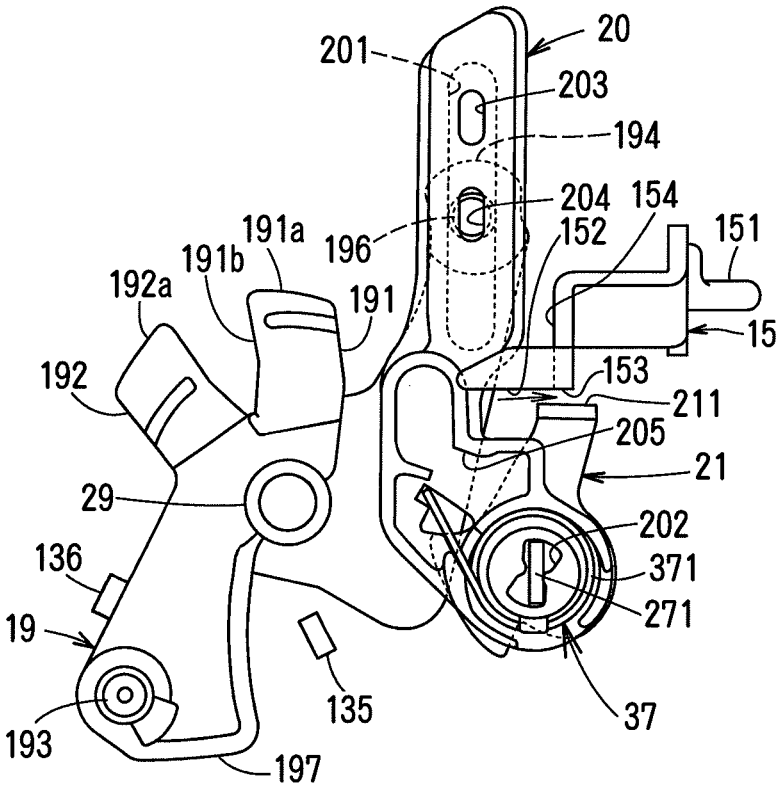
[FIG. 26] A third view of the main part when the panic occurs.

Opening operation of the outside handle (or the inside handle) stops once, and the outside lever 27 returns to the standby position. In FIG. 26, the second lift lever 21 goes out of the opening lever 15 and turns to the unlocking position by the force of the spring 37. The outside or inside handle is operated to open the door again, so that the door can be opened.

Embodiments of the present invention are described as above. Without departing from the gist of the invention, various variations and changes as below may be made to the embodiments.

(i) One of the first engagement projections 181,182 is provided on one of the rotary surfaces of the worm wheel 18, and one of the second engagement projections 183,184 is provided on the other rotary surface.

(ii) The first key lever 24 is integrally formed with the second key lever 25.

(iii) A gear driven by the motor 17 is a spur gear instead of the worm wheel 18.

(iv) The motor 17, worm wheel 18 and locking lever 19 which constitute an actuator are provided in a casing for the actuator separately formed from the casing 13 of the door larch device 1. The locking lever 19 is connected to the door latch device 1 via a motion-transmitting member such as a cable, a rod or a link.

What is claimed is:

1. A vehicle door lock device, comprising:

a casing;

a latch capable of engaging a striker of a vehicle;

a ratchet capable of engaging with the latch;

a pivot shaft fixed to the casing;

a motor mounted to the casing;

a worm wheel pivotally mounted to the casing via the pivot shaft and rotated by the motor, the worm wheel comprising a first flat rotary surface perpendicular to the pivot shaft and facing an inside of the vehicle at one side of the worm wheel, and a second flat rotary surface perpendicular to the pivot shaft and facing an outside of the vehicle at an opposite side of the worm wheel;

a first engagement projection mounted to the pivot shaft and located on the first flat rotary surface;

a second engagement projection mounted to the pivot shaft and located on the second flat rotary surface;

a locking lever pivotally mounted to the casing and comprising a first engagement arm and a second engagement arm circumferentially spaced from the first engagement arm to define a gap between the first and the second engagement arms, the first and second engagement arms facing the first flat and second flat rotary surfaces of the worm wheel respectively so that the worm wheel is received in the gap and is located between the first engagement arm and the second engagement arm of the locking lever, the locking lever having an abutted portion and being moveable between a locking position where the latch cannot be disengaged from the striker and an unlocking position where the latch can be disengaged from the striker, wherein when the locking lever is in the locking position, the first engagement projection abuts the first engagement arm, and the worm wheel is turned by the motor in a first direction to allow the locking lever to turn to the unlocking position in which the second engagement projection abuts an end of the second engagement arm to stop the worm wheel at a first stop position, and wherein when the locking lever is in the unlocking position, the second engagement projection abuts the second engagement arm, and the worm wheel is turned by the motor in a second direction opposite the first direction to allow the locking lever to turn to the locking position in which the first engagement projection abuts an end of the first engagement arm to stop the worm wheel at a second stop position;

a lift lever operatively connected to the locking lever and having a releasing portion;

an opening lever having a released portion with which the lift lever comes in contact to enable the ratchet to disengage from the latch when the locking lever is in the unlocking position;

an inside lever having an abutment portion, wherein even when the locking lever is in the locking position, the abutment portion of the inside lever operated by an inside handle comes in contact with the abutted portion of the locking lever to move the locking lever to the unlocking position to move the opening lever via the lift lever to disengage the ratchet from the latch and to disengage the latch from the striker, an outside lever operated by an outside handle and connected to the lift lever;

wherein when the locking lever is in the unlocking position the lift lever is in an unlocked state and is moveable by the outside lever to a position where the releasing portion of the lift lever abuts the released portion of the opening lever to disengage the ratchet from the latch and to permit the vehicle door to open when the outside handle is operated, and wherein when the locking lever is in the locking position the lift lever is in a locked state in which the lift lever is in a position that prevents the releasing portion of the lift lever to abut the released portion of the opening lever to prevent the vehicle door from opening even when the outside handle is operated.

2. The vehicle door lock device of claim 1 wherein the worm wheel meshes with a worm of a motor and rotates with the worm by the motor.

3. The vehicle door lock device of claim 1 further comprising on the casing a locking stopper which is in contact with the locking lever when the locking lever is in the locking position, and an unlocking stopper which is in contact with the locking lever when the locking lever is in the unlocking position.

4. The vehicle door lock device of claim 1 wherein when the locking lever is in the locking and unlocking positions, the first and second engagement projections are out of a turning path of the first and second engagement arms.

5. The vehicle door lock device of claim 1 wherein the end of the first engagement arm of the locking lever gradually decreases clockwise in a distance between the end of the first engagement arm and a center of the locking lever, and the end of the second engagement arm of the locking lever gradually decreases counterclockwise in a distance between the end of the second engagement arm and the center of the locking lever.

6. The vehicle door lock device of claim 5 wherein when the first engagement projection abuts on the end of the first engagement arm, the end of the first engagement arm is shaped such that a line of action of force from the first engagement projection to the locking lever extends in a direction for turning the locking lever to one of the locking and unlocking positions, and wherein when the second engagement projection abuts on the end of the second engagement arm, the end of the second engagement arm is shaped such that a line of action of force from the second engagement projection to the locking lever extends in a direction for turning the locking lever to the other of the lock and unlocking positions.

* * * * *